US008585189B1

(12) United States Patent
Marcus et al.

(10) Patent No.: US 8,585,189 B1
(45) Date of Patent: Nov. 19, 2013

(54) CONTROLLING DROP CHARGE USING DROP MERGING DURING PRINTING

(75) Inventors: Michael A. Marcus, Honeoye Falls, NY (US); Hrishikesh V. Panchawagh, San Jose, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/530,161

(22) Filed: Jun. 22, 2012

(51) Int. Cl.
*B41J 2/09* (2006.01)

(52) U.S. Cl.
USPC ..... 347/77

(58) Field of Classification Search
USPC ..... 347/73–82, 90
See application file for complete search history.

(56) References Cited

U.S. PATENT DOCUMENTS

| | | | | |
|---|---|---|---|---|
| 3,373,437 | A | 3/1968 | Sweet et al. | |
| 3,596,275 | A | 7/1971 | Sweet | |
| 3,656,171 | A | 4/1972 | Robertson | |
| 3,827,057 | A | 7/1974 | Bischoff et al. | |
| 3,946,399 | A | 3/1976 | Zaretsky | |
| 4,054,882 | A | 10/1977 | Ruscitto | |
| 4,068,241 | A | 1/1978 | Yamada | |
| 4,613,871 | A | 9/1986 | Katerberg | |
| 6,079,821 | A | 6/2000 | Chwalek et al. | |
| 6,235,212 | B1 | 5/2001 | Silverbrook | |
| 6,273,559 | B1 | 8/2001 | Vago et al. | |
| 6,312,110 | B1 | 11/2001 | Darty | |
| 6,450,619 | B1 | 9/2002 | Anagnostopoulos et al. | |
| 6,450,628 | B1 * | 9/2002 | Jeanmaire et al. | 347/75 |
| 6,509,917 | B1 | 1/2003 | Chwalek et al. | |
| 6,554,410 | B2 | 4/2003 | Jeanmaire et al. | |
| 6,588,888 | B2 | 7/2003 | Jeanmaire et al. | |
| 6,746,108 | B1 * | 6/2004 | Jeanmaire | 347/82 |
| 6,793,328 | B2 * | 9/2004 | Jeanmaire | 347/74 |
| 6,827,429 | B2 * | 12/2004 | Jeanmaire et al. | 347/77 |
| 6,851,796 | B2 * | 2/2005 | Jeanmaire et al. | 347/74 |
| 7,192,121 | B2 | 3/2007 | Barbet et al. | |
| 7,364,276 | B2 | 4/2008 | Piatt et al. | |
| 7,712,879 | B2 | 5/2010 | Barbet | |
| 7,938,516 | B2 | 5/2011 | Piatt et al. | |
| 8,091,983 | B2 * | 1/2012 | Xie et al. | 347/77 |
| 2006/0139408 | A1 | 6/2006 | Barbet et al. | |

(Continued)

OTHER PUBLICATIONS

Katerberg, J. A., "Drop Charging and Deflection Using a Planar Charge Plate", 4th International Congress on Advances in Non-Impact Printing Technologies The Society for Imaging Science and Technology, Mar. 20, 1988.

(Continued)

*Primary Examiner* — Kristal Feggins
(74) *Attorney, Agent, or Firm* — William R. Zimmerli

(57) ABSTRACT

A liquid jet is modulated to selectively cause the jet to break off into drop pairs and third drops traveling along a path using a drop formation device associated with the jet. Each drop pair is separated on average by a drop pair period and includes a first and second drop in response to input image data. The third drops, separated on average by the same drop pair period, are larger than the first and second drops in response to input image data. A waveform provided by a charging device has a period that is equal to the drop pair period, includes first and second distinct voltage states, and is independent of input image data. The charging device, synchronized with the drop formation device, produces first and second charge states on the first and second drops, respectively, of the drop pairs and a third charge state on the third drops.

25 Claims, 15 Drawing Sheets

(56) References Cited

U.S. PATENT DOCUMENTS

| | | | |
|---|---|---|---|
| 2009/0153627 | A1 | 6/2009 | Barbet |
| 2009/0225112 | A1 | 9/2009 | Barbet |
| 2009/0231398 | A1 | 9/2009 | Barbet |
| 2010/0033542 | A1 | 2/2010 | Piatt et al. |

OTHER PUBLICATIONS

Lord Rayleigh, "On the Instability of Jets," *Proc. London Math*. Soc. X (1878).

Panchawagh, H. et al., U.S. Appl. No. 13/115,434, "Ejecting Liquid Using Drop Charge and Mass", filed May 25, 2011.

Panchawagh, H. et al., U.S. Appl. No. 13/115,465, "Liquid Ejection System Including Drop Velocity Modulation", filed May 25, 2011.

Panchawagh, H. et al., U.S. Appl. No. 13/115,482, "Liquid Ejection Method Using Drop Velocity Modulation", filed May 25, 2011.

Panchawagh, H. et al., U.S. Appl. No. 13/115,421, "Liquid Ejection Using Drop Charge and Mass", filed May 25, 2011.

* cited by examiner

CONTROLLING DROP CHARGE USING DROP MERGING DURING PRINTING

FIELD OF THE INVENTION

This invention relates generally to the field of digitally controlled printing systems, and in particular to continuous printing systems in which a liquid stream breaks into drops some of which are deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed in a manner such that the liquid jet breaks up into drops of ink in a predictable manner. Printing occurs through the selective deflecting and catching of undesired ink drops. Various approaches for selectively deflecting drops have been developed including electrostatic deflection, air deflection, and thermal deflection mechanisms.

One well-known problem with any type inkjet printer, whether drop-on-demand or continuous ink jet, relates to the accuracy of dot positioning.

As is well-known in the art of inkjet printing, one or more drops are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printer drops are intended to be placed in desired locations within each pixel, for example in the center of each pixel area, for simple printing schemes, or, alternatively, in multiple precise locations within each pixel areas to achieve half-toning. If the placement of the drop is incorrect and/or their placement cannot be controlled to achieve the desired placement within each pixel area, image artifacts may occur, particularly if similar types of deviations from desired locations are repeated on adjacent pixel areas.

In a first electrostatic deflection based CIJ approach, the liquid jet stream is perturbed in some fashion causing it to break up into uniformly sized drops at a nominally constant distance, the break off length, from the nozzle. A charging electrode structure is positioned at the nominally constant break off point so as to induce a data-dependent amount of electrical charge on the drop at the moment of break off. The charged drops are then directed through a fixed electrostatic field region causing each droplet to deflect proportionately to its charge. The charge levels established at the break off point thereby cause drops to travel to a specific location on a recording medium or to a gutter for collection and recirculation.

This approach is disclosed by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure. A disclosure of a multi-jet CIJ printhead version utilizing this approach has also been made by Sweet et al. in U.S. Pat. No. 3,373,437 issued Mar. 12, 1968, Sweet '437 hereinafter. Sweet '437 discloses a CIJ printhead having a common drop generator chamber that communicates with a row (an array) of drop emitting nozzles each with its own charging electrode. This approach requires that each nozzle have its own charging electrode, with each of the individual electrodes being supplied with an electric waveform that depends on the image data to be printed. This requirement for individually addressable charge electrodes places limits on the fundamental nozzle spacing and therefore on the resolution of the printing system.

One known problem with these conventional CIJ printers is variation in the charge on the print drops caused by image data-dependent electrostatic fields from neighboring charged drops in the vicinity of jet break off and electrostatic fields from adjacent electrodes associated with neighboring jets. These input image data dependent variations are referred as electrostatic cross talk. Katerberg disclosed a method to reduce the cross-talk interactions from neighboring charged drops by providing guard gutter drops between adjacent print drops from the same jet in U.S. Pat. No. 4,613,871. However, electrostatic cross talk from neighboring electrodes limits the minimum spacing between adjacent electrodes and therefore resolution of the printed image. Thus, the requirement for individually addressable charge electrodes in traditional electrostatic CIJ printers places limits on the fundamental nozzle spacing and therefore on the resolution of the printing system. A number of alternative methods have been disclosed to overcome the limitation on nozzle spacing by use of an array of individually addressable nozzles in a nozzle array and one or more common charge electrodes at constant potentials. This is accomplished by controlling the jet break off length as described by Vago et al. in U.S. Pat. No. 6,273,559 and by B. Barbet and P. Henon in U.S. Pat. No. 7,192,121. T. Yamada disclosed a method of printing using a charge electrode at constant potential based on drop volume in U.S. Pat. No. 4,068,241. B. Barbet in U.S. Pat. No. 7,712,879 disclosed an electrostatic charging and deflection mechanism based on break off length and drop size using common charge electrodes at constant potentials.

Other known problems with electrostatic deflection based CIJ printing systems include electrostatic interactions between adjacent drops which cause alterations of their in-flight paths and result in degraded print quality and drop registration. P. Ruscitto in U.S. Pat. No. 4,054,882 described a method of non-sequential printing of ink drops issuing sequentially from a nozzle so that drops issuing sequentially from the nozzle are never printed adjacent to one another. This is done by applying multiple voltage states to deflection electrodes in sequence and requires different voltage state waveforms dependent on the image sequence to be printed. V. Bischoff et al. in U.S. Pat. No. 3,827,057 and J. Zaretsky in U.S. Pat. No. 3,946,399 described arrangements for compensating the charge to be applied to a drop being formed to correct for the effects of the charge on the drop which was just previously formed by altering the voltage applied during formation of the present drop.

High speed and high quality inkjet printing requires that closely spaced drops of relatively small volumes are accurately directed to the receiving medium. Since ink drops are usually charged there are drop to drop interactions between adjacent drops from adjacent nozzles in a CIJ printer. These interactions can adversely affect drop placement and print quality. In electrostatic based CIJ printer systems using high density nozzle arrays the main source of drop placement error on a receiver is due to electrostatic interactions between adjacent charged print drops.

As the pattern of drops traverse from the printhead to the receiving medium (throw distance), through an electrostatic deflection zone, the relative spacing between the drops progressively changes depending on the print drop pattern. When closely spaced print drops from adjacent nozzles are similarly charged while traveling in air, electrostatic interactions will cause the spacing of these adjacent neighboring print drops to increase as the print drops travel toward the receiving medium. This results in printing errors which are observed as a spreading of the intended printed liquid pattern in an outward direction and are termed "splay" errors or cross-track drop placement errors herein. Since splay errors increase with increasing throw distance it is required that the throw distance be as short as possible which adversely affects print margin defined as the separation between print drops and gutter drops.

As such, there is an ongoing need to provide a high print resolution continuous inkjet printing system that electrostatically deflects selected drops using an individually addressable nozzle array and a common charge electrode with reduced drop placement errors caused by electrostatic interactions having a simplified design, improved print image quality and improved print margin.

SUMMARY OF THE INVENTION

It is an object of the invention to overcome at least one of the deficiencies described above by using mass charging and electrostatic deflection with a CMOS-MEMS printhead to create high resolution high quality prints while maintaining or improving drop placement accuracy and minimizing drop volume variation of printed drops.

Image data dependent control of drop formation via break off of each of the liquid jets and a charge electrode that has a image data independent time varying electrical potential, called a charge electrode waveform, are provided by the present invention. The charge electrode waveform has a period equal to the drop pair period. Drop formation is controlled to cause portions of liquid jets to break off into pairs of drops generated at a drop pair period which are subsequently merged or to cause portions of the liquid jet to break off into one or more third drops which are larger than either of the drops making up the drop pairs dependent on the input image data. The charge electrode waveform and the drop formation waveforms are synchronized with each other to alternately charge successive drops of the drop pairs into one of two charge states while the third drops are all charged into the same charge state. A drop merging mechanism is used to combine the two individual drops of the drop pairs. A deflection device is then utilized to separate the paths of the merged drop pair drops and the third drops so that they travel along different paths.

The present invention improves CIJ printing by decreasing drop to drop electrostatic interactions, thus resulting in improved drop placement accuracy over previous CIJ printing systems. When two adjacent drops having opposite charge states on them are combined to form a print drop the combined charge will be lower on the print drops and close to 0 which will effectively remove most of the electrostatic interactions between adjacent print drops. The present invention also reduces the complexity of control signals sent to stimulation devices associated with nozzles of the nozzle array. This helps to reduce the complexity of charge electrode structures and enables using increased spacing between the charge electrode structures and the nozzles. The present invention also allows for longer throw distances by lowering the electrostatic interactions between adjacent print drops.

According to an aspect of the invention, a continuous liquid ejection system and method are provided. The method of ejecting liquid drops includes providing liquid under pressure sufficient to eject a liquid jet through a nozzle of a liquid chamber; providing input image data; and providing a drop formation device. The liquid jet is modulated to selectively cause portions of the liquid jet to break off into one or more pairs of drops traveling along a path using the drop formation device associated with the liquid jet. Each pair of drops is separated on average by a drop pair period. Each pair of drops includes a first drop and a second drop in response to the input image data. The liquid jet is modulated to selectively cause portions of the liquid jet to break off into one or more third drops traveling along the path separated on average by the same drop pair period using the drop formation device. The third drop is larger than the first drop and the second drop in response to the input image data.

A charging device is provided and includes a charge electrode associated with the liquid jet; and a source of varying electrical potential between the charge electrode and the liquid jet. The source of varying electrical potential provides a charging waveform. The waveform has a period that is equal to the drop pair period. The waveform includes a first distinct voltage state and a second distinct voltage state. The charging waveform is independent of the input image data. The charging device is synchronized with the drop formation device to produce a first charge state on the first drop of the drop pairs, to produce a second charge state on the second drop of the drop pairs, and to produce a third charge state on the third drops.

A drop merging mechanism and a deflection mechanism are provided. The first drop and the second drop of the drop pairs are caused to combine with each other to form a fourth drop having a fourth charge state using the drop merging mechanism. The third drop is caused to begin traveling along a first trajectory and the fourth drop is caused to begin traveling along a second trajectory using the deflection mechanism. The first and second trajectories are different when compared to each other.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
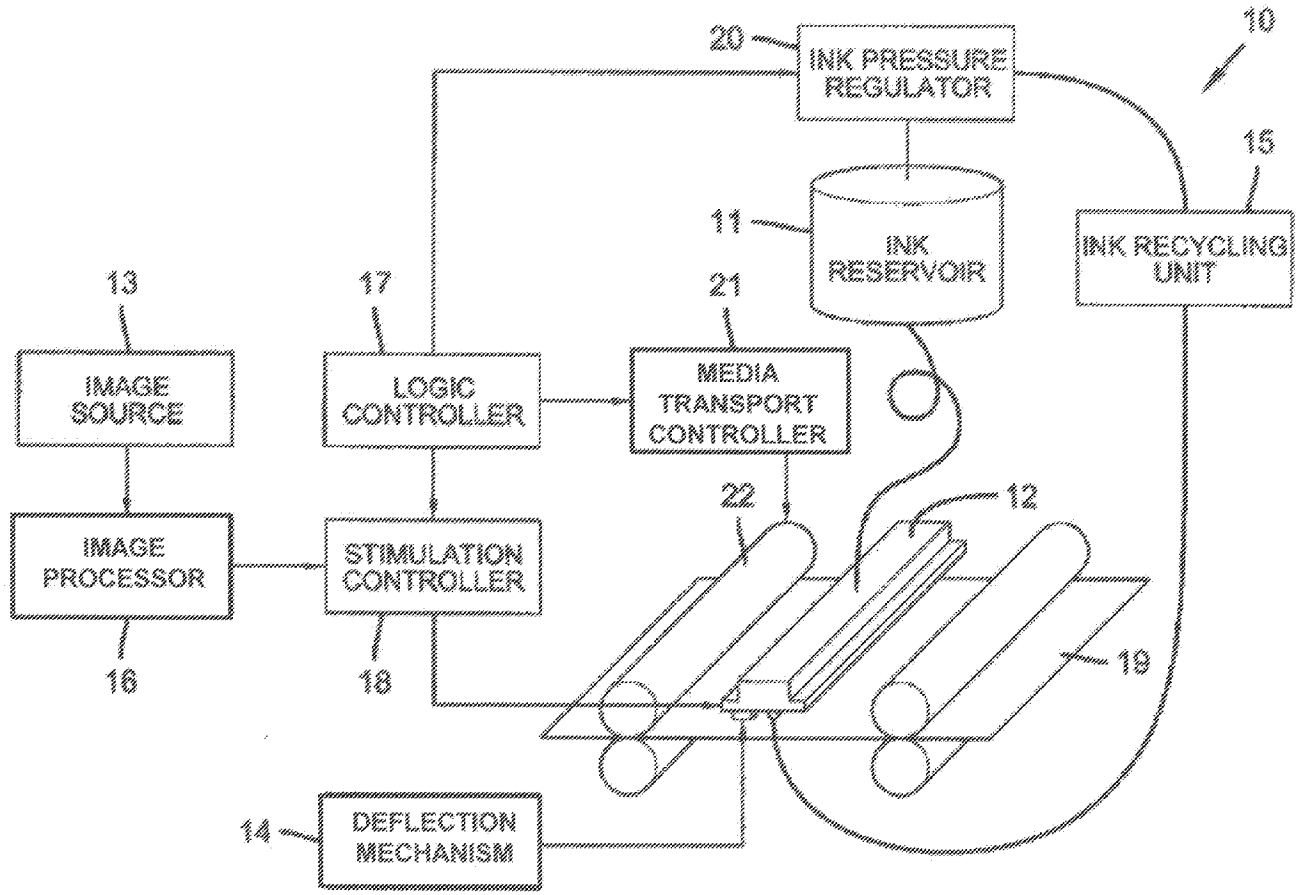
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, example embodiments of the present invention provide a printhead or printhead components typically used in inkjet printing systems. In such systems, the liquid is an ink for printing on a recording media. However, other applications are emerging, which use inkjet print heads to emit liquids (other than inks) that need to be finely metered and be deposited with high spatial resolution. As such, as described herein, the terms "liquid" and "ink" refer to any material that can be ejected by the printhead or printhead components described below.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a liquid jet of diameter dj, moving at a velocity vj. The jet diameter dj is approximately equal to the effective nozzle diameter do and the jet velocity is proportional to the square root of the reservoir pressure P. Rayleigh's analysis showed that the jet will naturally break up into drops of varying sizes based on surface waves that have wavelengths $\lambda$ longer than $\pi$dj, i.e. $\lambda \geq \pi dj$. Rayleigh's analysis also showed that particular surface wavelengths would become dominate if initiated at a large enough magnitude, thereby "stimulating" the jet to produce mono-sized drops. Continuous ink jet (CU) drop generators employ a periodic physical process, a so-called "perturbation" or "stimulation" that has the effect of establishing a particular, dominate surface wave on the jet. The stimulation results in the break off of the jet into mono-sized drops synchronized to the fundamental frequency of the perturbation. It has been shown that the maximum efficiency of jet break off occurs at an optimum frequency $F_{opt}$ which results in the shortest time to break off. At the optimum frequency $F_{opt}$ (optimum Rayleigh frequency) the perturbation wavelength $\lambda$ is approximately equal to 4.5dj. The frequency at which the perturbation wavelength $\lambda$ is equal to $\pi$dj is called the Rayleigh cutoff frequency $F_R$, since perturbations of the liquid jet at frequencies higher than the cutoff frequency won't grow to cause a drop to be formed.

The drop stream that results from applying Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal can be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, can be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present invention. Drops of predetermined volume each have an associated portion of the drop forming waveform responsible for the creation of the drop. Satellite drops don't have a distinct portion of the waveform responsible for their creation. Thus the phrase "predetermined volume" as used to describe the present invention should be understood to comprehend that some small variation in drop volume about a planned target value may occur due to unpredictable satellite drop formation.

The example embodiments discussed below with reference to FIGS. 1-11 are described using particular combinations of components, for example, particular combinations of drop charging structures, drop deflection structures, drop catching structures, drop formation devices, and drop velocity modulating devices. It should be understood that these components are interchangeable and that other combinations of these components are within the scope of the invention.

Figure 2:
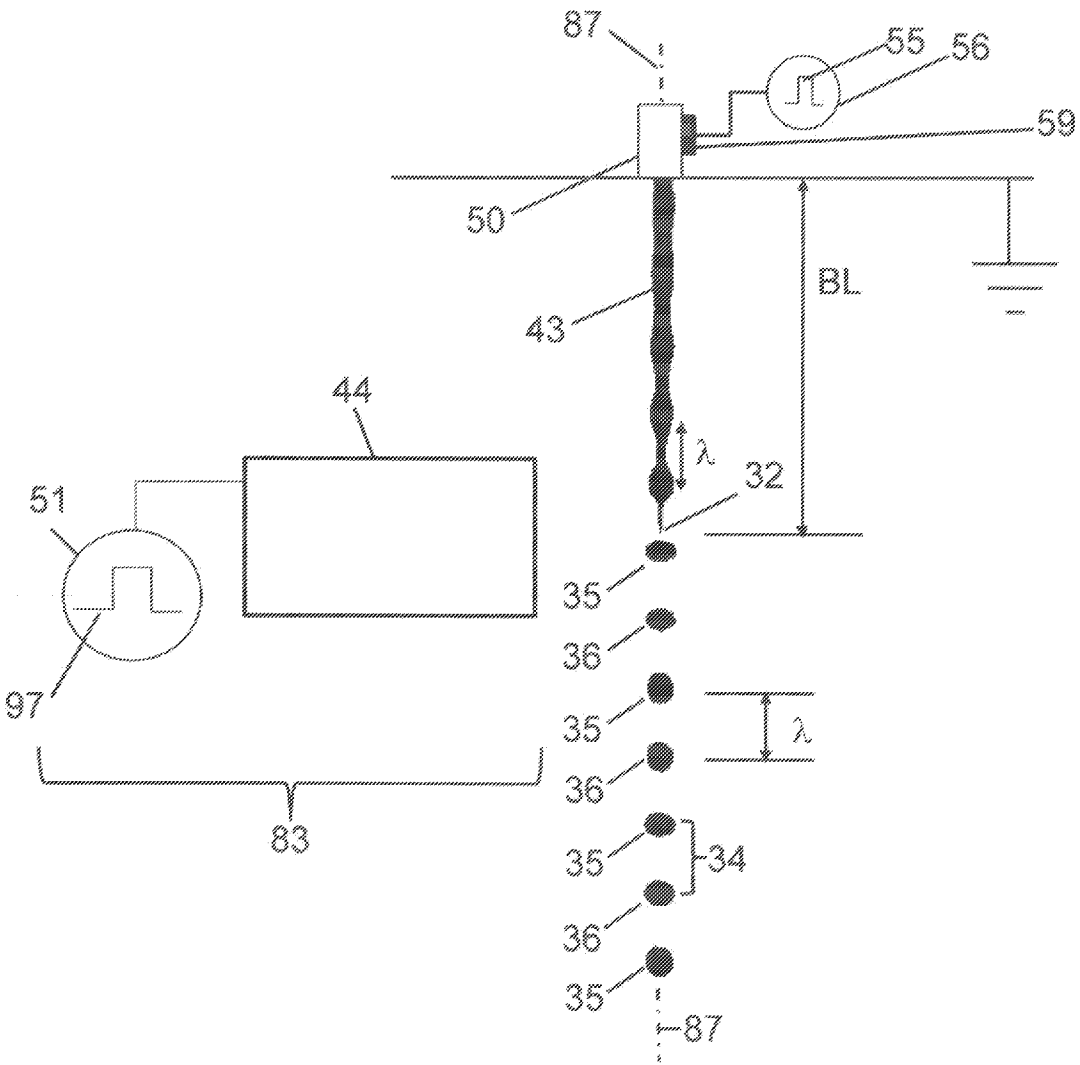
FIG. 2 shows an image of a liquid jet being ejected from a drop generator and its subsequent break off into drops at its fundamental period $\tau_o$ having a drop spacing $\lambda$.
Figure 3:
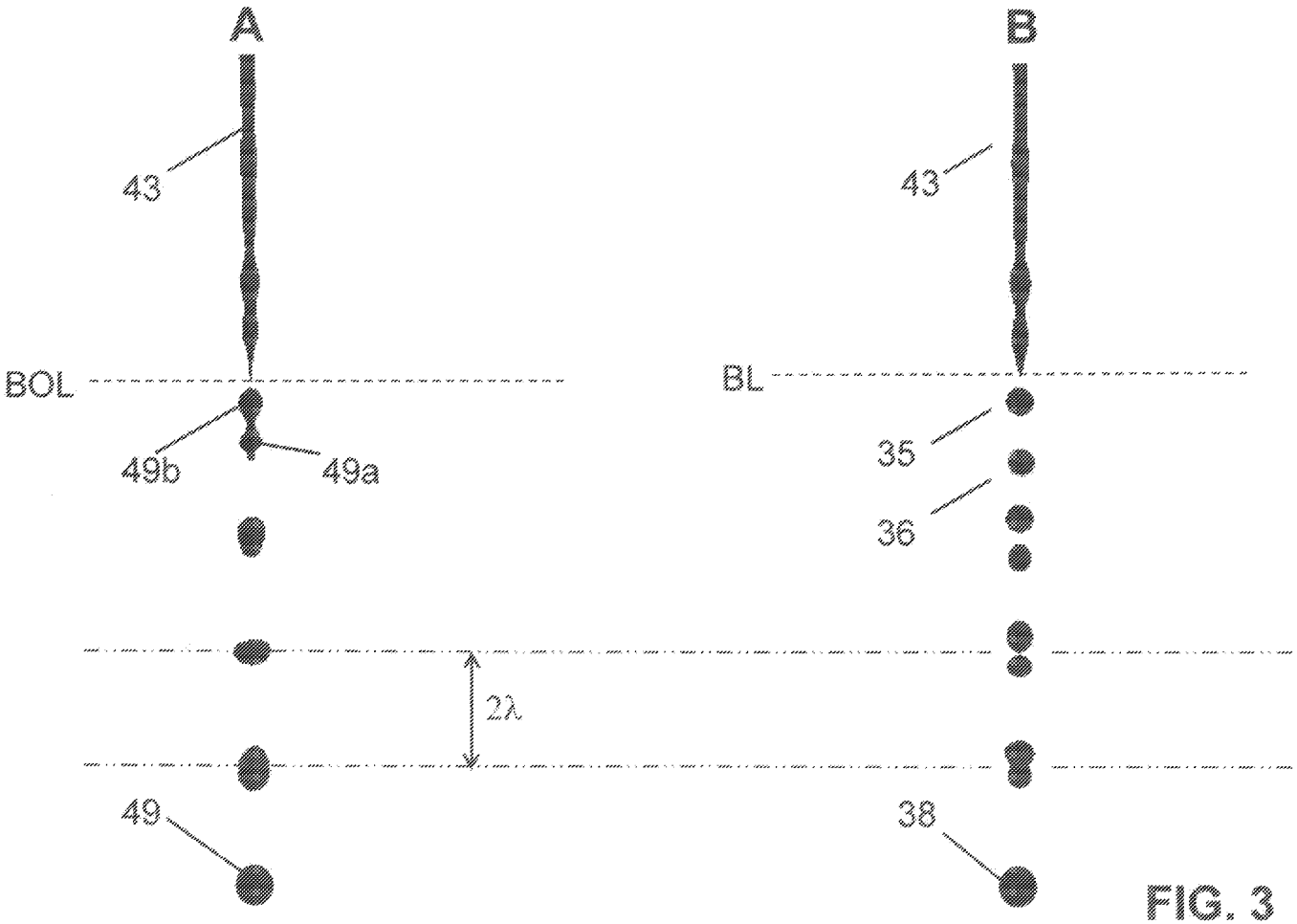
FIG. 3 shows images of liquid jets being ejected from a drop generator and its subsequent break off into (A) third drops at twice its fundamental period $\tau_o$ having a drop spacing $2\lambda$ and (B) drop pairs which later combine to form fourth drops.

A continuous inkjet printing system 10 is illustrated in FIG. 1, and FIG. 2 shows an image of a liquid jet 43 being ejected from a single drop generator of a printhead 12 and its subsequent break off into drops 35 and 36 at its fundamental period $\tau_o$ having an adjacent drop spacing $\lambda$. The continuous inkjet printing system 10 includes an ink reservoir 11 that continuously pumps ink into a printhead 12 also called a liquid ejector or drop generator to create a continuous stream of ink drops. Printing system 10 receives digitized image process data from an image source 13 such as a scanner, computer or digital camera or other source of digital data which provides raster image data, outline image data in the form of a page description language, or other forms of digital image data. The image data from the image source 13 is sent periodically to an image processor 16. Image processor 16 processes the image data and includes a memory for storing image data. The image processor 16 is typically a raster image processor (RIP), which converts the received image data into print data, a bitmap of pixels for printing. The print data is sent to a stimulation controller 18, which generates stimulation waveforms 55; patterns of time-varying electrical stimulation pulses to cause a stream of drops to form at the outlet of each of the nozzles on printhead 12, as will be described. These stimulation pulses are applied at an appropriate time and at an appropriate frequency to stimulation device(s) 59 associated with each of the nozzles 50 with appropriate amplitudes, duty cycles, and timings to cause drops 35 and 36 to break off from the continuous stream 43. The printhead 12 and deflection mechanism 14 work cooperatively in order to determine whether ink droplets are printed on a recording medium 19 in the appropriate position designated by the data in image memory, or deflected and recycled via the ink recycling unit 15. The recording medium 19 is also called a receiver and it is commonly composed of, but not limited to, paper, polymer, or some other porous substrate. The ink in the ink recycling unit 15 is directed back into the ink reservoir 11. The ink is distributed under pressure to the back surface of the printhead 12 by an ink channel that includes a chamber or plenum formed in a substrate typically constructed of silicon. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20. The deflection mechanism 14 is an electrostatic drop deflection mechanism.

The RIP or other type of processor 16 converts the image data to a pixel-mapped image page image for printing. Image data can include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

During printing, recording medium 19 is moved relative to printhead 12 by means of a plurality of transport rollers 22 which are electronically controlled by media transport controller 21. A logic controller 17, preferably micro-processor based and suitably programmed as is well known, provides control signals for cooperation of transport controller 21 with the ink pressure regulator 20 and stimulation controller 18. The stimulation controller 18 comprises one or more stimulation waveform sources 56 that generate drop formation waveforms in response to the print data and provide or applies the drop formation waveforms 55, also called stimulation waveforms, to the stimulation device(s) 59 also called drop formation device(s) 59 associated with each nozzle 50 or liquid jet 43. In response to the energy pulses of applied stimulation waveforms, the drop formation device 59 perturbs the continuous liquid stream 43, also called a liquid jet 43, to cause individual liquid drops to break off from the liquid stream. The drops break off from the liquid jet 43 at a distance BL from the nozzle plate. The information in the image processor 16 thus can be said to represent a general source of data for drop formation, such as desired locations of ink droplets to be printed and identification of those droplets to be collected for recycling.

It can be appreciated that different mechanical configurations for receiver transport control can be used. For example, in the case of a page-width printhead, it is convenient to move recording medium 19 past a stationary printhead 12. On the other hand, in the case of a scanning-type printing system, it is more convenient to move a printhead along one axis (i.e., a main-scanning direction) and move the recording medium along an orthogonal axis (i.e., a sub-scanning direction), in relative raster motion.

Drop forming pulses are provided by the stimulation controller 18, which can be generally referred to as a drop controller, and are typically voltage pulses sent to the printhead 12 through electrical connectors, as is well-known in the art of signal transmission. However, other types of pulses, such as optical pulses, can also be sent to printhead 12, to cause printing and non-printing drops to be formed at particular nozzles, as is well-known in the inkjet printing arts. Once formed, printing drops travel through the air to a recording medium and later impinge on a particular pixel area of the recording medium or are collected by a catcher as will be described.

Referring to FIG. 2 the printing system has associated with it, a printhead that is operable to produce from an array of nozzles 50 an array of liquid jets 43. Associated with each liquid jet 43 are a drop formation device 59 and a drop formation waveform source 56 that supplies a stimulation waveform 55, also called a drop formation waveform, to the drop formation device. The drop formation device 59, commonly called a drop formation transducer or a stimulation transducer, can be of any type suitable for creating a perturbation on the liquid jet, such as a thermal device, a piezoelectric device, a MEMS actuator, an electrohydrodynamic device, an optical device, an electrostrictive device, and combinations thereof.

Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop formation waveform source 56 supplies a drop formation waveform having a fundamental frequency $f_o$ and a fundamental period of $\tau_o=1/f_o$ to the drop formation transducer, which produces a modulation with a wavelength $\lambda$ in the liquid jet. The modulation grows in amplitude to cause portions of the liquid jet break off into drops. Through the action of the drop formation device, a sequence of drops are produced at a fundamental frequency $f_o$ with a fundamental period of $\tau_o=1/f_o$.

In FIG. 2, liquid jet 43 breaks off into drops with a regular period at break off location 32, which is a distance BL from the nozzle 50. The distance between a pair of successive drops 35 and 36 is essentially equal to the wavelength $\lambda$ of the perturbation on the liquid jet. The pair of successive drops 35 and 36 that break off from the liquid jet forms is called a drop pair 34, each drop pair having a first drop 36 and a second drop 35. Thus, the frequency of formation of drop pair 34, commonly called the drop pair frequency $f_p$, is given by $f_p=f_o/2$ and the corresponding drop pair period is $\tau_p=2\tau_o$. Usually the drop stimulation frequency of the stimulation transducers for the entire array of nozzles 50 in a printhead is the same for all nozzles in the printhead 12.

Also shown in FIG. 2 is a charging device 83 comprising charge electrode 44 and charging voltage source 51. The charging voltage source 51 supplies a charge electrode waveform 97 which controls the voltage signal applied to the charge electrode. The charge electrode 44 is associated with the liquid jet and is positioned adjacent to the break off point 32 of the liquid jet 43. When a non-zero voltage is applied to the charge electrode 44, an electric field is produced between the charge electrode and the electrically grounded liquid jet. The capacitive coupling between the charge electrode and the electrically grounded liquid jet induces a net charge on the end of the electrically conductive liquid jet. (The liquid jet is grounded by means of contact with the liquid chamber of the grounded drop generator.) If the end portion of the liquid jet breaks off to form a drop while there is a net charge on the end of the liquid jet, the charge of that end portion of the liquid jet is trapped on the newly formed drop. When the voltage level on the charge electrode is changed, the charge induced on the liquid jet changes due to the capacitive coupling between the charge electrode and the liquid jet. Hence, the charge on the newly formed drops can be controlled by varying the electric potential on the charge electrode.

The drop formation dynamics of drops forming from a liquid stream being jetted from an inkjet nozzle can be varied by altering the waveforms applied to the respective drop formation transducer associated with a particular nozzle orifice. Changing at least one of the amplitude, duty cycle or timing relative to other pulses in the waveform or in a sequence of waveforms can alter the drop formation dynamics of a particular nozzle orifice. It has been found that the drop forming pulses of the drop formation waveform can be adjusted to form a single larger drop also called a third drop or large drop 49 as shown in FIG. 3A. A segment of the jet that is two successive fundamental wavelengths long can either break off as a single large drop 49 that stays together, break off as a single larger drop that then separates into two drops 49*a* and 49*b* and subsequently merge together, or break off as two separate drops 49*a* and 49*b* which later merge together. The large drops 49 are produced at half the fundamental frequency which is equal to the drop pair period $\tau_p=2\tau_o$. The average spacing between adjacent large drops is $2\lambda$ and they break off from the jet at the break off plane BOL shown in FIG. 3A. In the practice of this invention, the drop formation waveforms 55, supplied to the drop formation transducer, that generate the large drops 49 are designed to produce break off lengths of the large drops (BOL) which are similar to the break off lengths (BL) of the smaller drops 35 and 36 shown in FIG. 2 and FIG. 3B.

In various embodiments of this invention, the voltage on the charging electrode 44 is controlled by the charging pulse source 51 which provides a two state waveform operating at the drop pair frequency $f_p$ given by $f_p=f_o/2$, that is half the fundamental frequency or equivalently at a drop pair period $\tau_p=2\tau_o$, that is twice the fundamental period $2\tau_o$ to produce two distinct charge states on successively formed drops 36 and 35 of drop pairs 34. Thus, the charging pulse voltage source 51 provides a varying electrical potential between the charging electrode 44 and the liquid jet 43. The source of varying electrical potential generates a charge electrode waveform 97, the charge electrode waveform has a period that is equal to the drop pair period, and the charge electrode waveform includes a first distinct voltage state and a second distinct voltage state. The timing of the stimulation waveforms applied to the drop formation devices and the timing of the charging pulse source applied to the charge electrode are synchronized so that the first drop 36 of a drop pair breaks off during the first voltage state and produces a first charge state on the first drop, and the second drop 35 of the drop pair breaks off during the second voltage state and produces a second charge state on the second drop of the drop pair. In the practice of this invention drops 36 and 35 are made to subsequently merge to form a merged drops or fourth drops 38 which have a fourth charge state. The timing of the stimulation waveforms applied to the drop formation devices and the timing of the charging pulse source applied to the charge electrode are also synchronized so that when large drops or third drops 49 are generated they all break off during the same voltage state of the charge electrode producing a third charge state on the third drops. The third drops and the fourth drops are substantially the same size and the third charge state and the fourth charge state are distinct from each other. In all embodiments of this invention the minimum time interval between successive print drops is $2\tau_o$ which is equal to a drop pair time interval. The drop pair time interval is also equal to the charge electrode stimulation waveform period. The drop pair time interval is also called the print cycle. The print cycle is defined as the minimum time interval in which successive print drops can be printed using the embodiments of the invention.

In a binary printer, sequences of print or non print drops are generated in response to the input image data. During printing, communication signals from the stimulation controller 18 applied to the drop formation stimulation waveform source 56 are used to determine the order of formation of print and non-print drops, and the waveform source 56 provides different print drop and non-print drop stimulation waveforms 55 to the drop formation device. In the practice of this invention, one of the third drops and fourth drops are print drops and the other of third drops or fourth drops are non-print drops.

Figure 4:
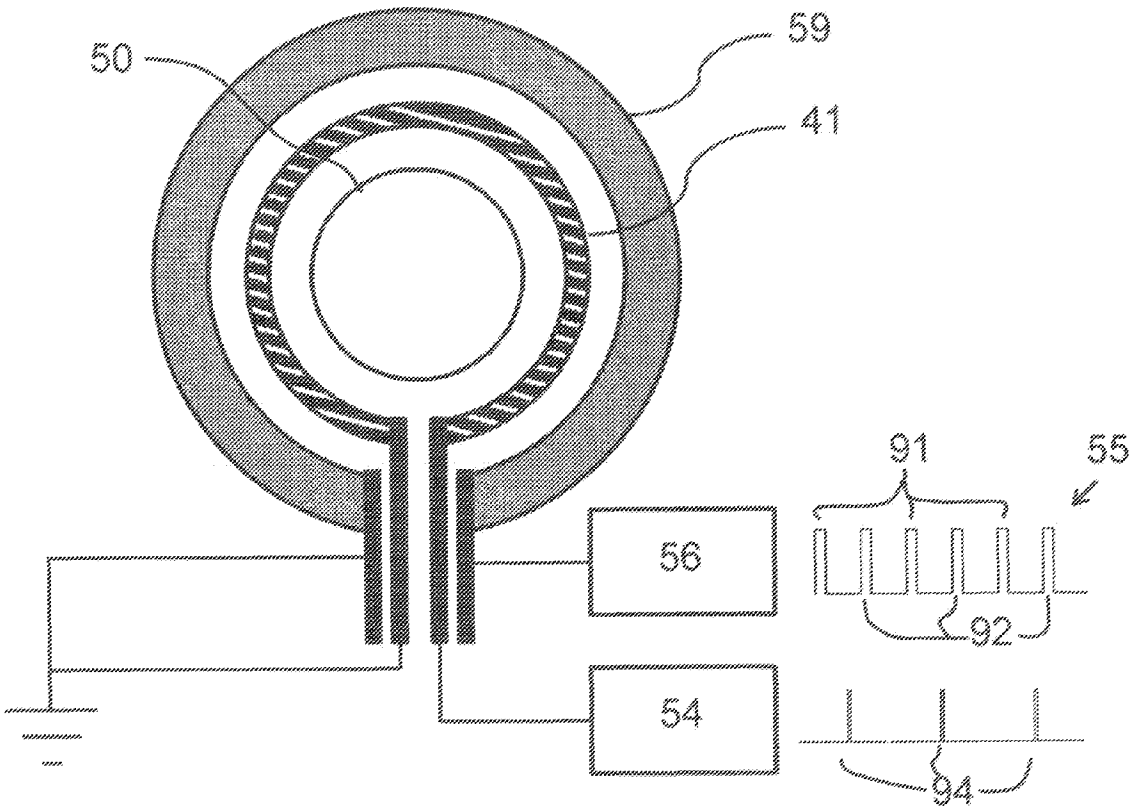
FIG. 4 is a simplified block schematic diagram of a nozzle and associated drop formation device and velocity modulation device according to an example embodiment of the invention.
Figure 5:
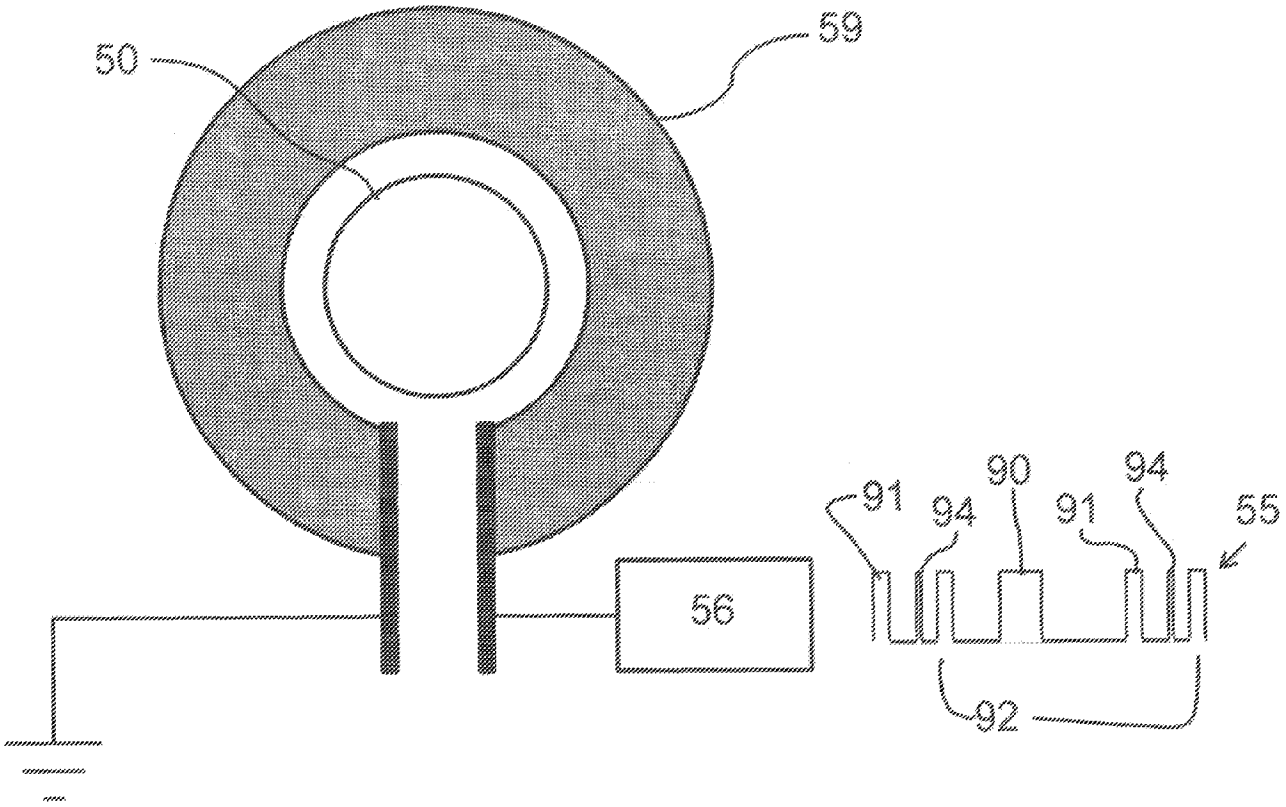
FIG. 5 is a simplified block schematic diagram of a nozzle and an associated stimulation device according to another example embodiment of the invention.

The liquid jets are modulated using the drop formation device to selectively cause portions of the liquid jet to break off into one or more pairs of drops traveling along a path using the drop formation device associated with the liquid jet, each pair of drops separated on average by a drop pair period, each pair of drops including a first drop 36 and a second drop 35 in response to the input image data. The first and second drops of every drop pair are made to combine (merge) with each other to form a merged drop 38 as shown in FIG. 3B, using a drop merging mechanism which is also associated with the liquid jets. The drop merging mechanism varies the velocity of the first and second drops of a drop pair relative to each other so that they merge. The drop merging mechanism can comprise a drop velocity modulation transducer 41 that is distinct from the drop forming transducer 59 as shown in FIG. 4, or a drop velocity modulation transducer that is the same transducer as the drop forming transducer as shown in FIG. 5. The liquid jets are also modulated using the drop formation device to selectively cause portions of the liquid jet to break off into one or more third drops traveling along the path separated on average by the same drop pair period using the drop formation device, the third drop being larger than the first drop and the second drop in response to the input image data as shown in FIG. 3A.

As stated above a drop merging mechanism comprises a drop velocity modulation transducer associated with the liquid jet. The drop velocity modulation transducer can be one of a thermal device, a piezoelectric device, a MEMS actuator, an electrohydrodynamic device, an optical device, an electrostrictive device, and combinations thereof. Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop velocity modulation device is employed to alter or modulate the velocity of the first drop, the second drop, or both drops in a drop pair to cause the first and second drop in a drop pair to merge. As small changes in the amplitude, the duty cycle and waveform timing of the energy pulses transferred to the liquid jet to form the drops affect the velocity of the formed drops, the velocity of one or both drops in a drop pair can be modulated and is accomplished by altering the characteristics of the energy transferred to the liquid jet that create the perturbations on the liquid jet that cause the drops to break off from the liquid stream. The drop velocity modulation waveform depends on the print or image data and is only applied when drop pairs are produced.

FIG. 4 and FIG. 5 show example embodiments of the invention showing suitable drop merging mechanisms using velocity modulation pulses and thermal actuators. FIG. 4 shows an example in which the needed small changes in the amplitude, the duty cycle, and waveform timing of the energy pulses transferred to the liquid jet to affect the velocity of the formed drops are provided by means of a separate velocity modulation device transducer 41 while FIG. 5 shows an example in which the needed small changes in the amplitude, the duty cycle, and waveform timing of the energy pulses transferred to the liquid jet to affect the velocity of the formed drops are provided by modifying the pulses applied to the drop formation transducer or stimulation transducer 59. In the configuration shown in FIG. 4 the velocity modulation device transducer 41 and the drop formation device transducer 59 are separate heaters concentrically placed around the nozzle 50. The drop formation waveform source 56 supplies an image-data dependent drop stimulation waveform 55 made up of a sequence of voltage pulses to the drop stimulation transducer 59 which causes modulation in the liquid jet flowing through the nozzle 50 in response to the input image data. An image data dependent sequence of drop velocity modulating pulses 94 is applied to the drop velocity modulation device transducer 41 by the velocity modulation source 54. The short sequence of voltage pulses making up the drop stimulation waveform 55 consisting of first drop forming pulses 91 and second drop forming pulses 92 is shown for the case of 3 successive drop pairs which are to be merged into fourth drops. The timing of the drop velocity modulating pulses 94 applied to the drop velocity modulation device transducer 41 is such that the second drop 35 of a drop pair 34 is faster than the first drop 36, which will cause the second drop to overtake and subsequently merge with each the first drop as they travel along an initial path 87. When the first drop and the second drops are charged to opposing polarities, the electrostatic attraction between the two drops can help accelerate the first and second drops toward each other.

In the embodiment shown in FIG. 5, the drop stimulation transducer 59 and the drop velocity modulation device are the same device. Image-data dependent drop stimulation waveforms 55 made up of sequences of voltage pulses supplied by the drop stimulation waveform source 56 are applied to the drop stimulation transducer 59 which causes modulation in the liquid jet flowing through the nozzle 50 in response to the input image data. The short sequence of voltage pulses making up the drop stimulation waveform 55 is shown for the case of a drop pair followed by a third drop which is followed by a second drop pair. The drop pair forming pulses consists of first drop forming pulses 91 and of second drop forming pulses 92 and includes velocity modulating pulses 94 occurring in the time interval in between the first and second drop forming pulses. This short pulse 94 is not enough energy to cause a drop to break off, but tends to accelerate the second drop of the drop pair. The third drop forming pulse consists of a longer pulse 90. If a sequence of third drops is to be formed subsequent pulses 90 will be separated in time by twice the fundamental period of drop formation $2\tau_o$.

Figure 6A:
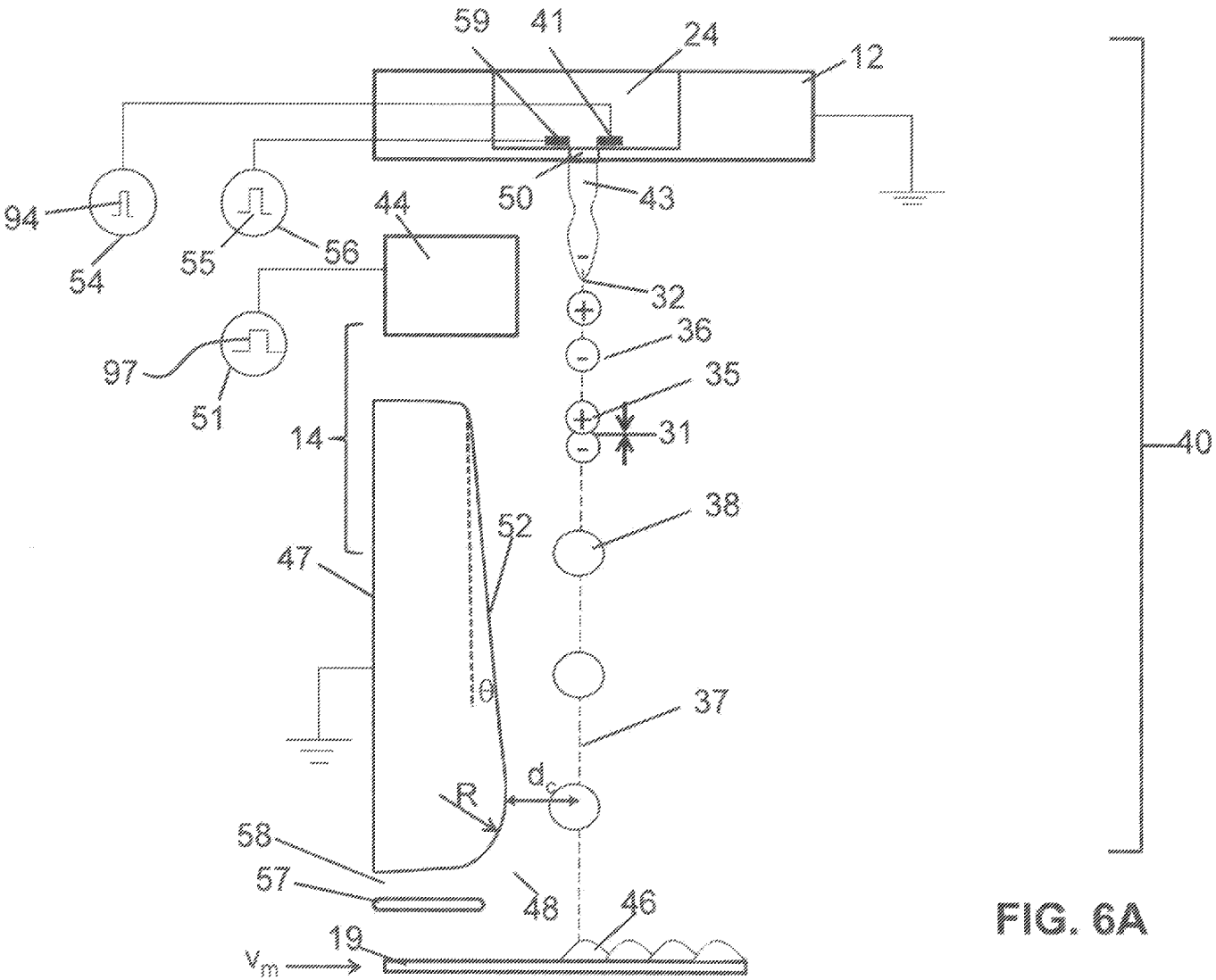
FIG. 6A shows a cross sectional viewpoint through a liquid jet of a first embodiment of the continuous liquid ejection system according to this invention and operating in an all print condition.
Figure 6B:
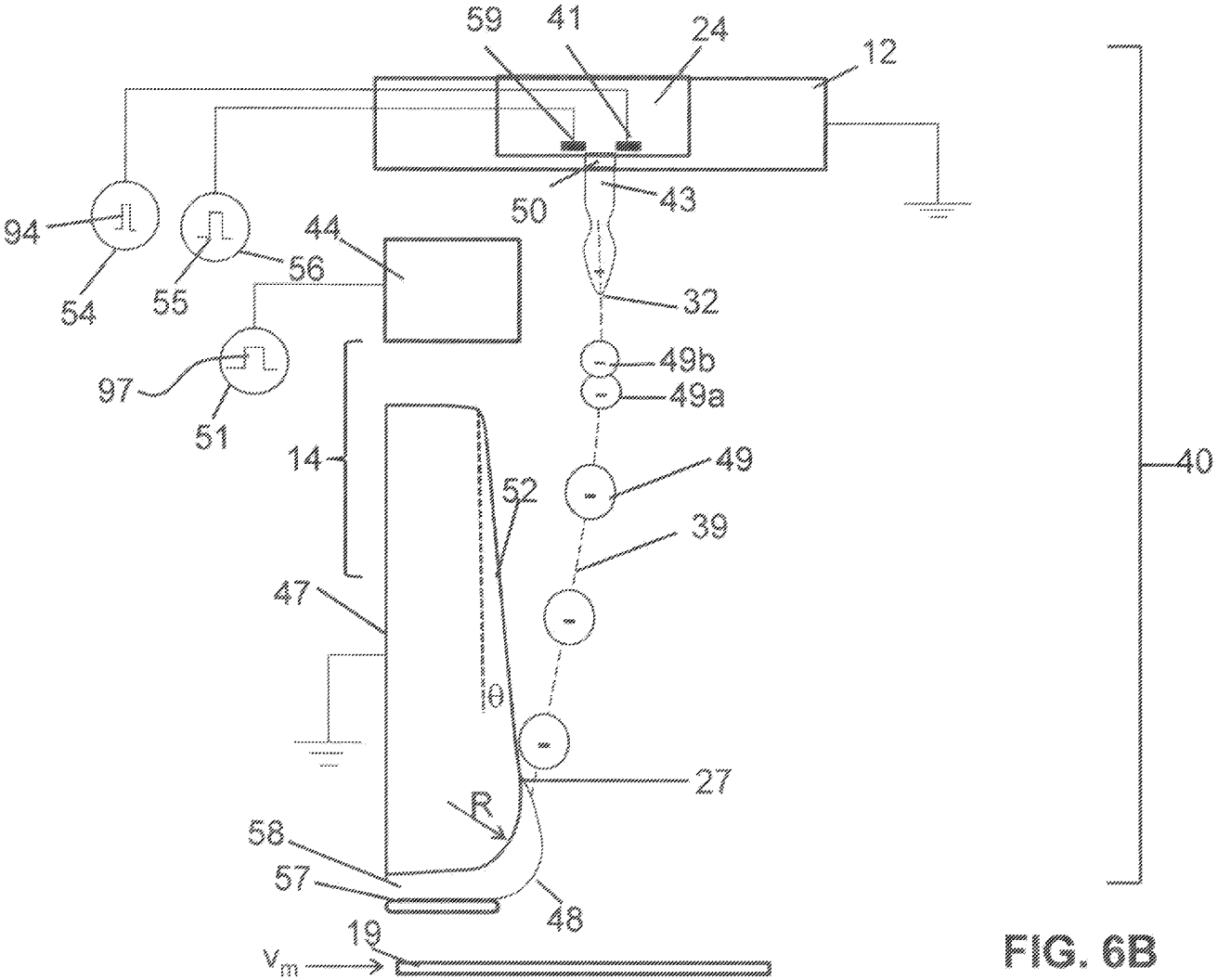
FIG. 6B shows a cross sectional viewpoint through a liquid jet of a first embodiment of the continuous liquid ejection system according to this invention and operating in a no print condition.
Figure 6C:
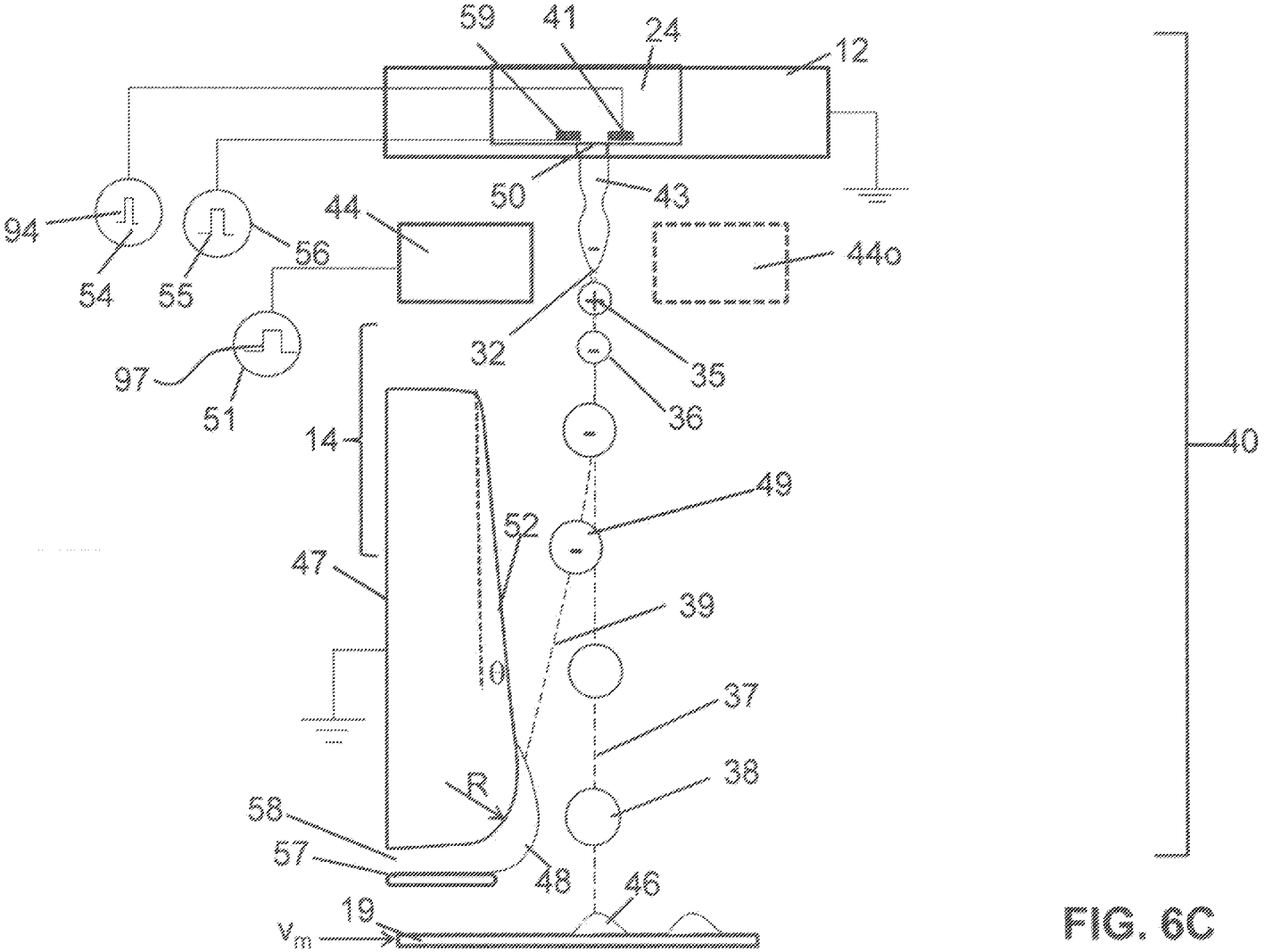
FIG. 6C shows a cross sectional viewpoint through a liquid jet of a first embodiment of the continuous liquid ejection system according to this invention and illustrates a general print condition.
Figure 7A:
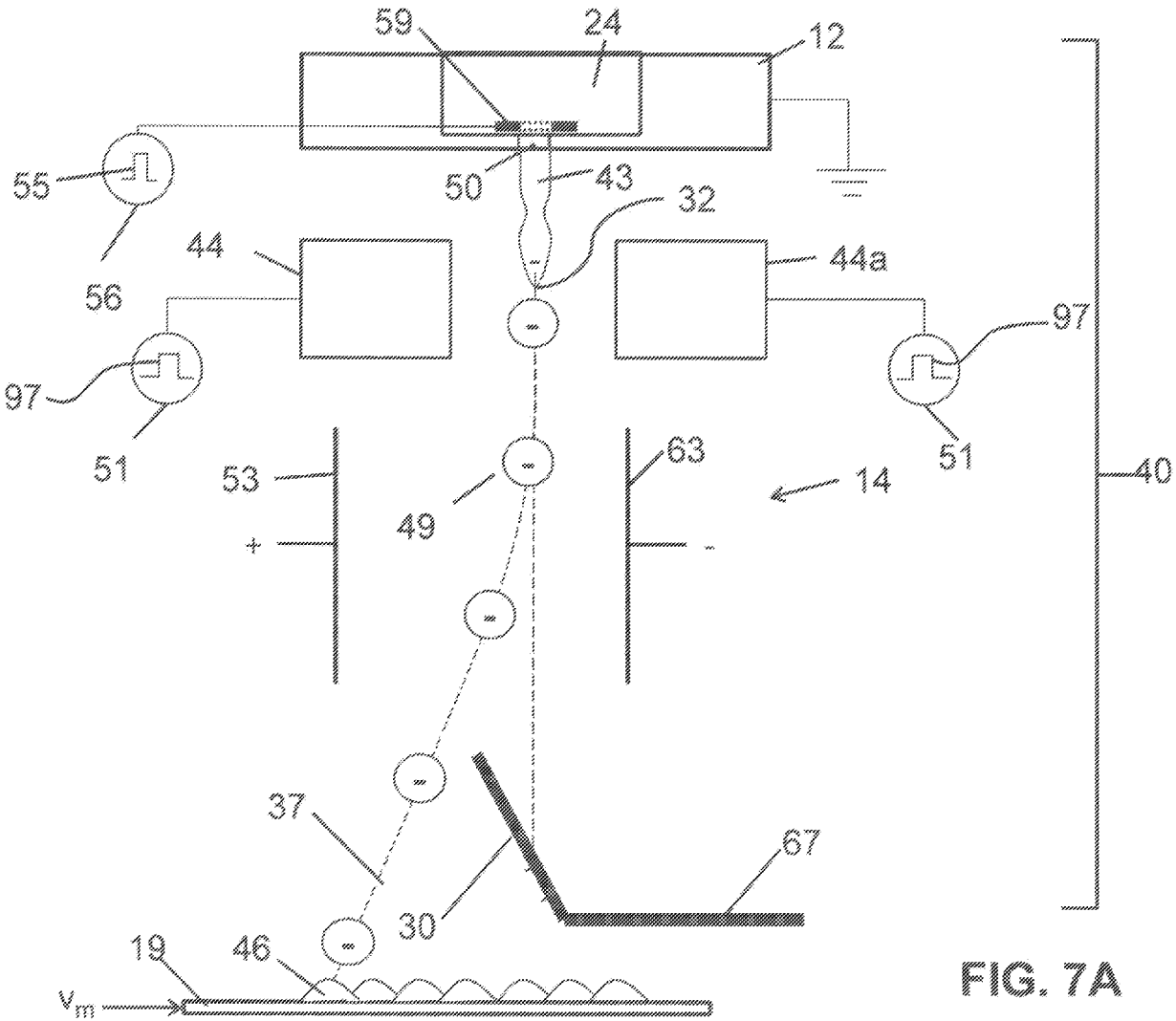
FIG. 7A shows a cross sectional viewpoint through a liquid jet of an alternate embodiment of the continuous liquid ejection system according to this invention and operating in an all print condition.
Figure 7B:
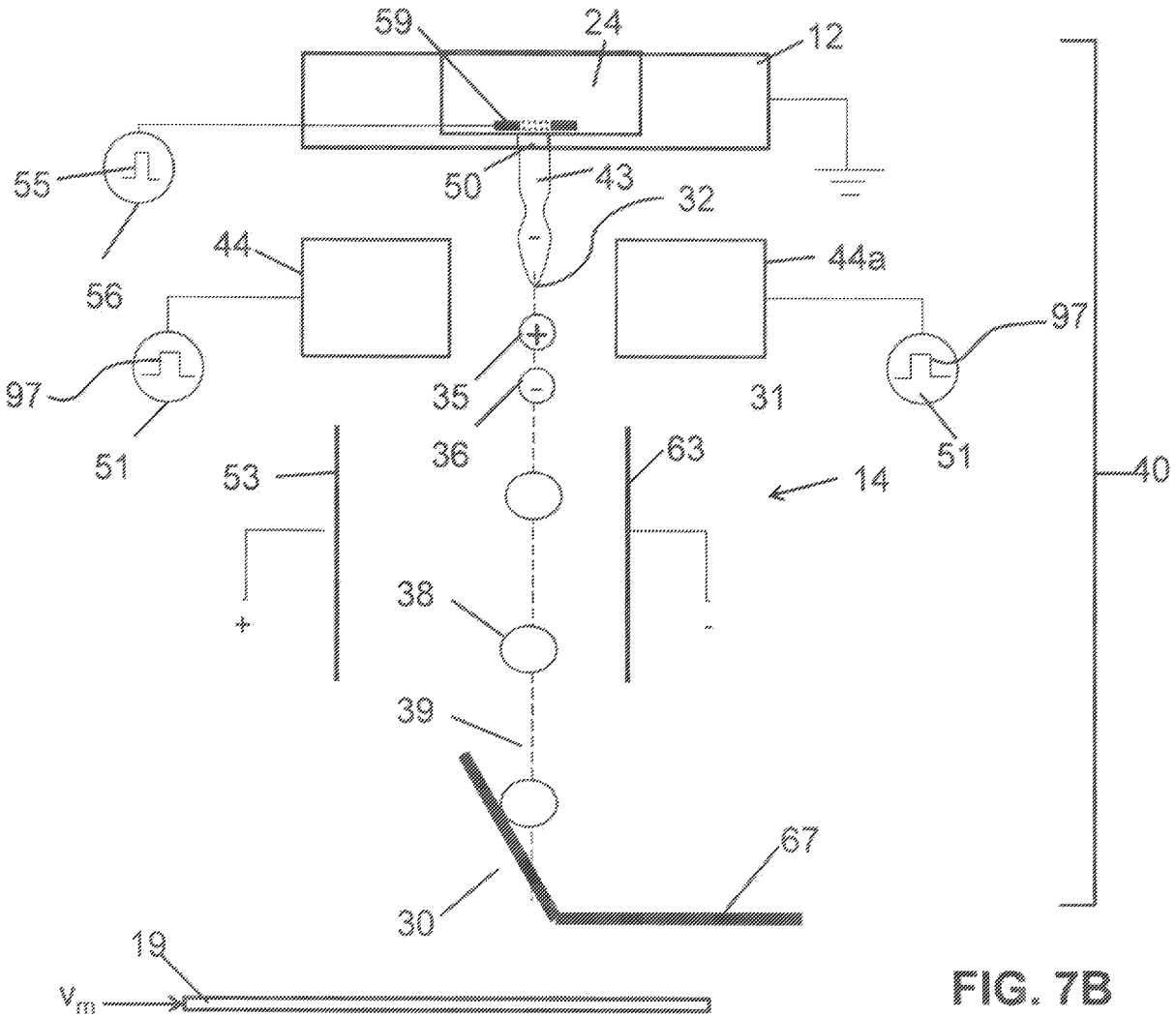
FIG. 7B shows a cross sectional viewpoint through a liquid jet of an alternate embodiment of the continuous liquid ejection system according to this invention and operating in a no print condition.
Figure 7C:
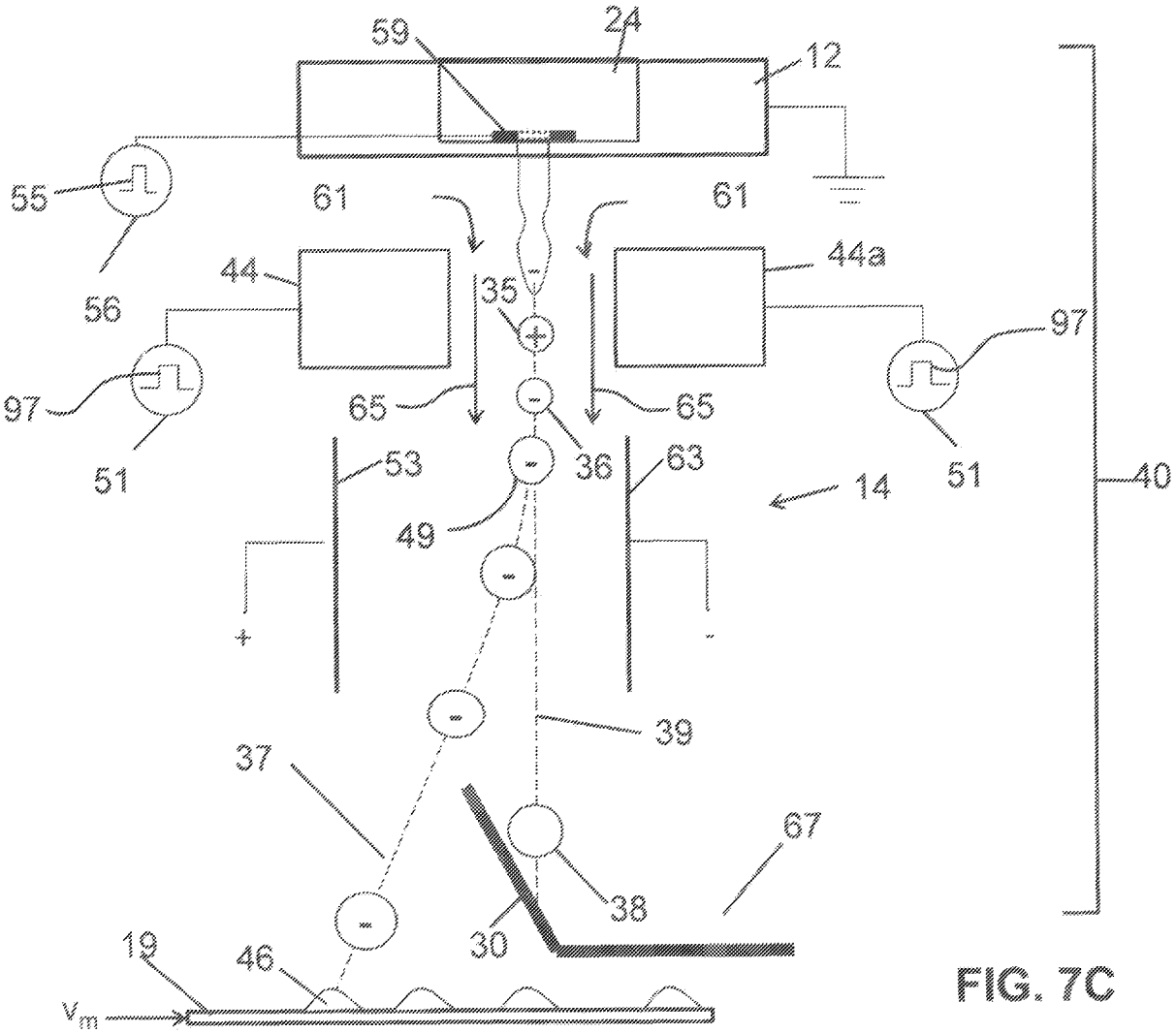
FIG. 7C shows a cross sectional viewpoint through a liquid jet of an alternate embodiment of the continuous liquid ejection system according to this invention and operating in a general print condition.

FIGS. 6A-7C show cross sectional viewpoints through a single liquid jet of embodiments of continuous liquid ejection systems 40 used in the practice of this invention. FIG. 6A, FIG. 6B and FIG. 6C show a first embodiment of the continuous liquid ejection system according to this invention and operating in an all print condition, a no print condition and a general print condition respectively. The all print condition is defined as every drop formed at twice the fundamental period $2\tau_o$ being printed, the no print condition is defined as none of the drops formed at twice the fundamental period $2\tau_o$ being printed, and the general print condition is defined as some of the drops formed at twice the fundamental period $2\tau_o$ being printed, and other drops being formed at twice the fundamental period $2\tau_o$ not being printed. FIG. 7A, FIG. 7B and FIG. 7C show a second embodiment of the continuous liquid ejection system according to this invention and operating in an all print condition, a no print condition and a general print condition respectively.

In the various embodiments of the invention, the continuous liquid ejection system 40 includes a printhead 12 comprising a liquid chamber 24 in fluid communication with an array of one or more nozzles 50 for emitting liquid jets 43. Liquid is supplied under a pressure sufficient to eject liquid jets through the nozzles of the liquid chamber. Associated with each liquid jet is a stimulation transducer 59. In the embodiments shown, the stimulation transducer 59 is formed in the wall around the nozzle 50. Separate stimulation transducers 59 can be integrated with each of the nozzles in a plurality of nozzles. The stimulation transducer 59 is actuated by a drop formation waveform source 56 which provides the periodic stimulation of the liquid jet 43 in the form of drop stimulation waveforms which are dependent on the input image data. In these embodiments, the periodic stimulation of the liquid jets 43 causes the jets to break off into sequences of drop pairs 34 spaced in time by the drop pair period $2\tau_o$ traveling along a path, or into sequences of larger drops 49 spaced in time by $2\tau_o$ and separated from each other by the distance $2\lambda$ traveling along the path. The larger drops 49 can be formed by the merging of 2 separate drops 49*a* and 49*b* which break off closely in time as shown in FIG. 6B or as a single large drop 49 as shown in FIG. 7A. The embodiments shown in FIG. 6A-6C also include a separate drop velocity modulation transducer 41 surrounding each of the nozzles 50. A velocity modulation source 54 supplies drop velocity modulating pulses 94 to the drop velocity modulation transducers 41 as described previously.

The energy of the stimulation waveforms applied to the liquid jets is controlled so that all drops break off from the liquid stream 43 adjacent to the charge electrode 44 which is common to all of the nozzles of the plurality of nozzles in the printhead 12. The charging pulse voltage source 51 supplies a time varying electrical potential (charge electrode waveform 97) between the charging electrode 44 and the liquid jet 43 which is usually grounded. The charge electrode waveform has a period that is equal to the drop pair period and includes a first distinct voltage state and a second distinct voltage state. The timing of the stimulation waveforms applied to the drop formation devices and the timing of the charging pulse source applied to the charge electrode are synchronized to produce a first charge state on the first drop 36 of a drop pair indicated by a negative sign, a second charge state on the second drop 35 of a drop pair indicated by a positive sign and a third charge state on the third drops 49 indicated by a bold negative sign. Second drops 35 and first drops 36 of drop pairs are subsequently made to merge to form fourth drops 38, having a fourth charge state shown as having neutral charge. The third drops and the fourth drops are substantially the same size, whereas the third charge state and the fourth charge state are distinct from each other. FIG. 6C also shows an optional symmetric charge electrode 44*o* shown in a dotted outline which is preferably located at the same height and same distance from the liquid jet as charge electrode 44. The optional symmetric charge electrode 44*o* is supplied with the same charge electrode waveform 97 from the same charging pulse voltage source 51 supplied to charge electrode 44. The embodiments in FIG. 7A-7C also include symmetric charge electrode 44*a* which is also supplied with a charge electrode waveform 97 from the same charging pulse voltage source 51 supplied to charge electrode 44. During operation it is desirable to adjust the voltage levels of the two state charge electrode waveform so that the first drop 36 of a drop pair and the second drop 35 of a drop pair 34 have equal and opposite charge levels on them. When this is accomplished the merged drop 38 will have no net charge on it.

FIG. 6A to 6C show embodiments in which relatively non-charged drops are printed and highly charged drops are guttered and recycled whereas in the embodiments shown in FIG. 7A-7C highly charged drops are printed and relatively non-charged drops are guttered and recycled by being sent to the ink recycling unit 15. Both embodiments utilize charged drop deflection mechanisms 14 including catchers 47 or 67 which are positioned below the charge electrode 44 which are located appropriately to intercept and recycle non print drops which are caused to travel along a non-print drop trajectory 39 while print drops are caused to travel along a print drop trajectory 37 and are allowed to continue to a recording medium 19. When there is minimal charge on print drops they will travel along a trajectory which is substantially coincident with the path. When print drops contact the recording medium 19 while it is moving at a relative velocity $v_m$ with respect to the printhead 12 they form printed drops 46 on the recorded medium in regions corresponding to the input image data.

In the embodiment shown in FIGS. 6A-6B, the charge electrode 44 is part of the deflection device 14. When a voltage potential is applied to charge electrode 44 located to one side of the liquid jet adjacent to the break off point, the charge electrode 44 attracts the charged end of the jet prior to the break off of a drop, and also attracts the charged drops 36 and 49 after they break off from the liquid jet. This deflection mechanism has been described in J. A. Katerberg, "Drop charging and deflection using a planar charge plate", 4th International Congress on Advances in Non-Impact Printing Technologies. The catcher 47 also makes up a portion of the deflection device 14. As described in U.S. Pat. No. 3,656,171 by J. Robertson, charged drops passing in front of a conductive catcher face cause the surface charges on the conductive catcher face 52 to be redistributed in such a way that the charged drops are attracted to the catcher face 52. In the embodiments shown in FIGS. 6A-6C, the third drops 49 are highly charged and deflected toward and captured by the catcher 47 and recycled while the print drops have a relatively low charge and are shown as being relatively undeflected. In practice, the print drops may be slightly deflected away from the catcher and allowed to hit the recording medium. For proper operation of the printhead 12 shown in FIGS. 6A-6C, the catcher 47 and/or the catcher bottom plate 57 are grounded to allow the charge on the intercepted drops to be dissipated as the ink flows down the catcher face 52 and enters the ink return channel 58. The catcher face 52 of the catcher 47 makes an angle θ with respect to the liquid jet axis 87 shown in FIG. 2. Charged third drops 49 are attracted to catcher face 52 of grounded catcher 47 and intercept the catch face 52 at charged drop catcher contact location 27 to form an ink film 48 traveling down the face of the catcher 47. The bottom of the catcher face has a curved surface of radius R, around which ink can flow from the catcher face 52 into the ink recovery channel 58. The ink recovery channel 58 is formed between the bottom of the catcher body and the bottom catcher plate 57 for capturing and recirculation of the ink in the ink film 48. If a positive voltage potential difference exists from the electrode 44 to the liquid jet 43 at the time of break off of a drop breaking off adjacent to the electrode, a negative charge will be induced on the forming drop that will be retained after break off of the drop from the liquid jet. Similarly, if a negative voltage potential difference exists from the electrode 44 to the liquid jet 43 at the time of break off of a drop breaking off adjacent to the electrode, a positive charge will be induced on the forming drop that will be retained after break off of the drop from the liquid jet. In some embodiments, drop 36 is made to break off when there is a positive potential difference between the electrode 44 and the liquid jet 43, and drop 35 is made to break off when there is a negative potential difference between the electrode 44 and the liquid jet 43 which causes drop 36 to have a negative charge and drop 35 to have a positive charge. In other embodiments the polarities are reversed. Thus these two drops undergo electrostatic attraction which tends to help these drops merge into merged drop 38.

FIGS. 7A-7C show an embodiment in which the print drops are highly charged and deflected away from a catcher 67 travelling along print drop path 37 and allowing the charged print drops to contact a recording medium and be printed. In this case, the print drops are large drops 49 and the catcher 67 intercepts less charged merged non-print drops 38 traveling along the non-print drop path 39 which is shown as being relatively undeflected. In this embodiment, a second charge electrode 44*a* is shown being positioned on the opposite side of the liquid jets 43 from charge electrode 44 so that the liquid jets break off between the two charge electrodes 44 and 44*a*. The charge electrodes 44 and 44*a* can be either two distinct electrodes with separate charging voltage sources or two portions of the same electrode which use the same charging voltage source 51. The electrode may be constructed out of a single conductive material with a parallel gap being machined between the two halves. The left and right portions of the charge electrode are usually biased to the same potential by the charging voltage source 51. The addition of the second charge electrode 44*a* on the opposite side of the liquid jet from charge electrode 44 biased to the same potential, produces a region between the charging electrode portions 44 and 44*a* with an electric field that is almost symmetric left to right about the center of the jet. As a result, the charging of drops breaking off from the liquid jet between the electrodes is very insensitive to small changes in the lateral position of the jet. The near symmetry of the electric field about the liquid jet allows drops to be charged without applying significant lateral deflection forces on the drops near break off. In this embodiment, the deflection mechanism 14 includes a pair of deflection electrodes 53 and 63 located below the charging electrodes 44 and 44*a* and below the merge point of drops 35 and 36 into a merged or fourth drop 38. The electrical potential between these two electrodes produces an electric field between the electrodes that deflects negatively charged drops to the left. The strength of the drop deflecting electric field depends on the spacing between these two electrodes and the voltage between them. In this embodiment, the deflection electrode 53 is positively biased, and the deflection electrode 63 is negatively biased. By biasing these two electrodes in opposite polarities relative to the grounded liquid jet, it is possible to reduce the influence of the drop deflection electric field on the charge of the drop breaking off from the liquid stream. In other embodiments, only a single deflection electrode may be used. In all cases, the deflection electrode is in electrical communication with a source of electrical potential that creates a drop deflection field to deflect charged drops.

In FIGS. 7A-7C, a knife edge catcher 67 has been used to intercept the non-print drop trajectories. Catcher 67, which includes a catcher ledge 30, is located below the pair of deflection electrodes 53 and 63. The catcher 67 and catcher ledge 30 are oriented such that the catcher intercepts non-print drops 38 traveling along the non-print drop path 39, but does not intercept charged large print drops 49 traveling along the print drop path 37. Preferably, the catcher is positioned so that the drops striking the catcher strike the sloped surface of the catcher ledge 30 to minimize splash on impact. The charged large print drops 49 are printed on the recording medium 19 as printed drops 46.

The charging voltage source 51 typically provides a drop charging waveform that is an approximately 50% duty cycle square wave waveform at half the fundamental frequency of drop formation. The break off timing of first drops 36 of drop pairs 34 and large drops 49 are synchronized with the charging voltage source so that they break off from the liquid jet 43 when electrodes 44 and 44*a* have a positive voltage applied to them during the first voltage state. This induces negative charges onto first drops 36 and onto large drops 49. Similarly the break off timing of second drops 35 of drop pairs 34 is synchronized with the charging voltage source so that they break off from the liquid jet during the second voltage state when electrodes 44 and 44*a* have a zero or negative voltage applied to them. When the voltage is switched to a low voltage on electrode 44 during formation of drop 36 there will a positive charge is induced on drop 35 as it breaks off from the grounded jet 43 due to capacitive coupling with the negatively charged preceding drop. Drops 35 and 36 are then merged with each other by applying velocity modulation pulses to velocity modulating transducer. The fields produced by the applied voltages on the deflection electrodes deflect the large drops 49 sufficiently so that they miss the gutter ledge 30 and be printed on recording medium 19. In the embodiment shown in FIG. 7C, an optional air plenum 61 is formed between the charge electrode and the nozzle plate of the geometry. Air, supplied to the air plenum by an air source (not shown), surrounds the liquid jet and stream of drops as they pass between the first and second charge electrodes, 44 and 44*a* respectively, as indicated by arrows 65. This air flow moving roughly parallel to the initial drop trajectories helps to reduce air drag effects on the drops that can produce drop placement errors.

Figure 8:
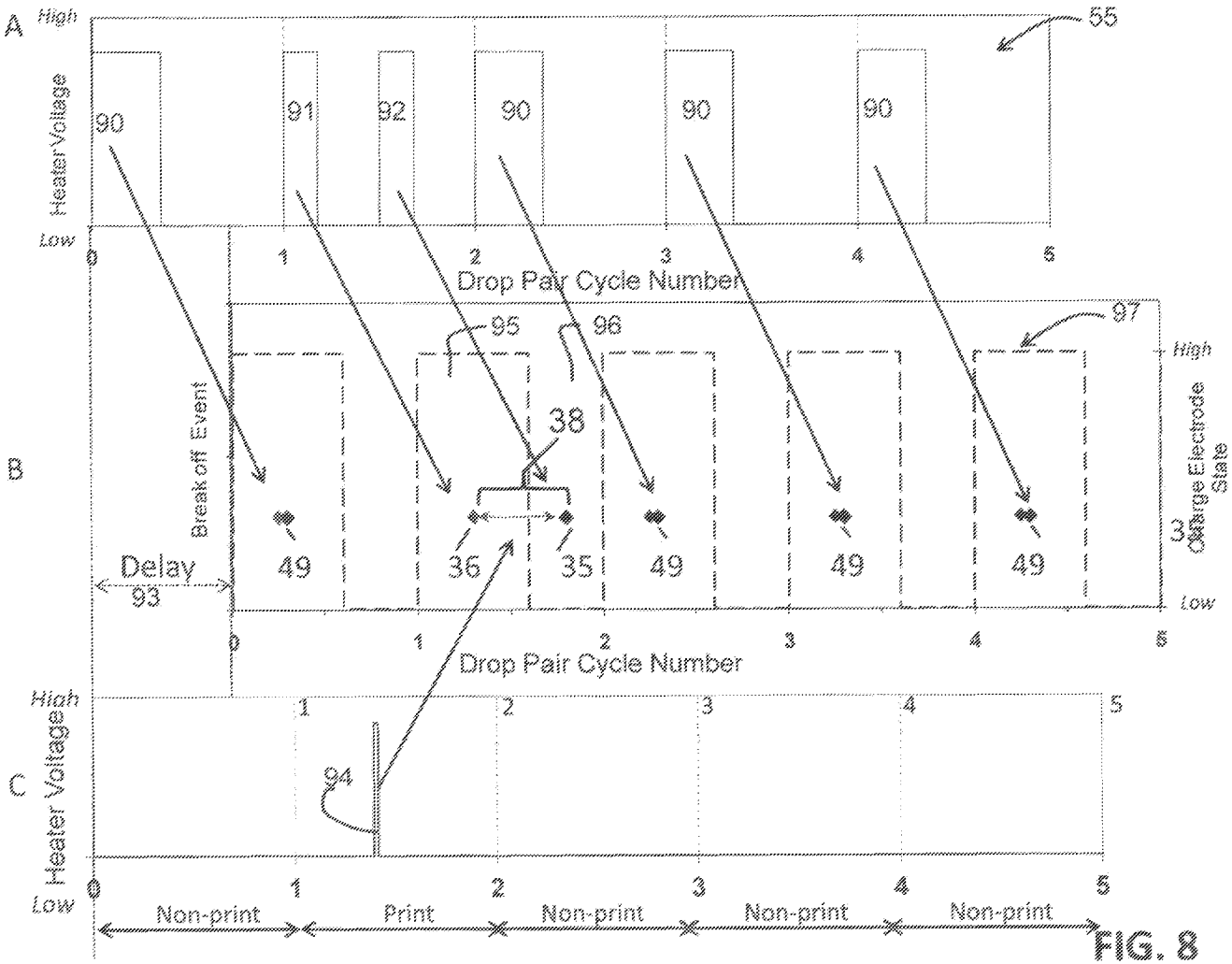
FIG. 8 shows a first embodiment of a timing diagram illustrating drop formation pulses (A), the charge electrode waveform and the break off of drops (B) and the velocity modulating pulses (C)
Figure 9:
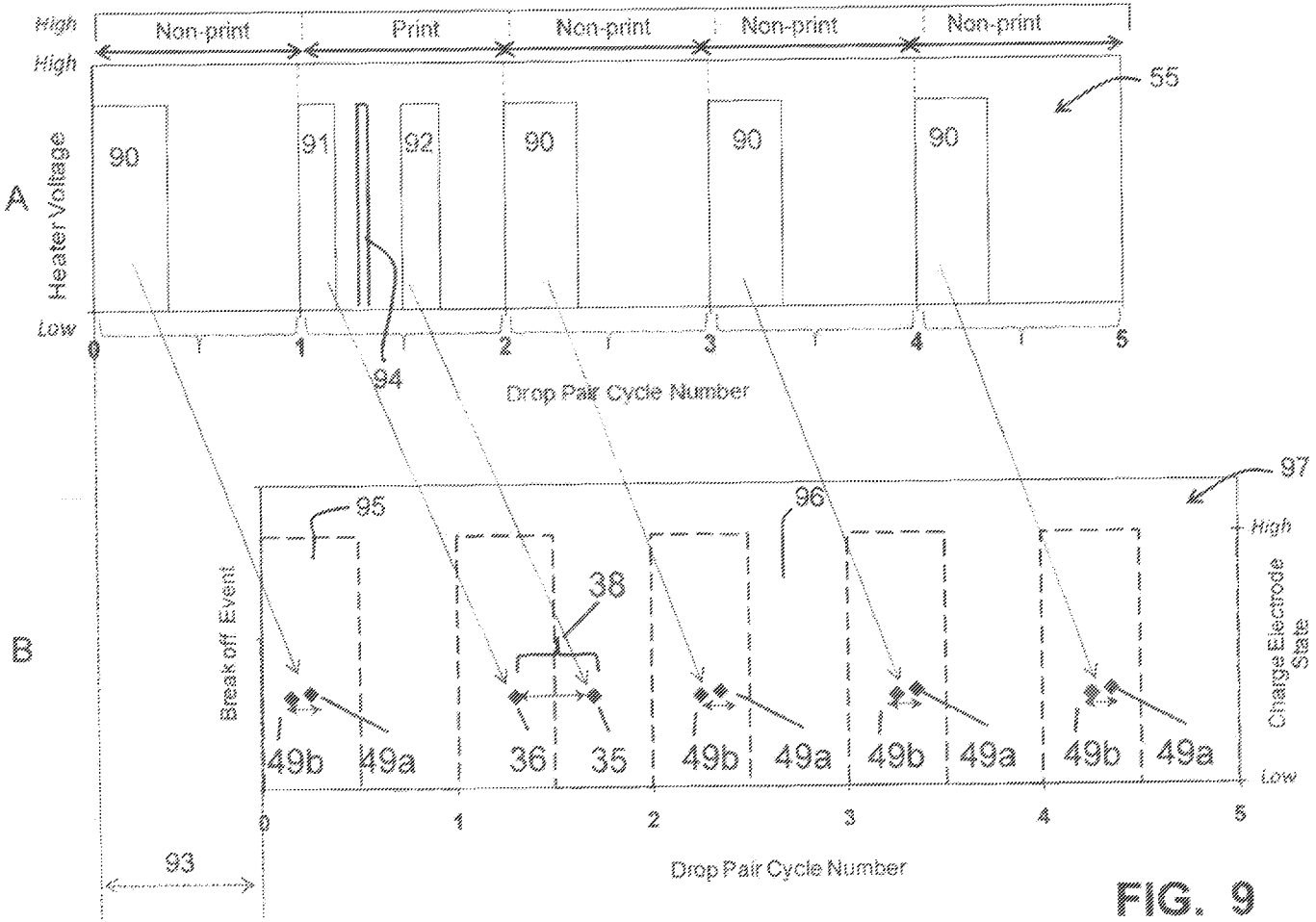
FIG. 9 shows a second embodiment of a timing diagram illustrating drop formation pulses, velocity modulating pulses (A) and the charge electrode waveform, and the break off of drops (B)
Figure 10:
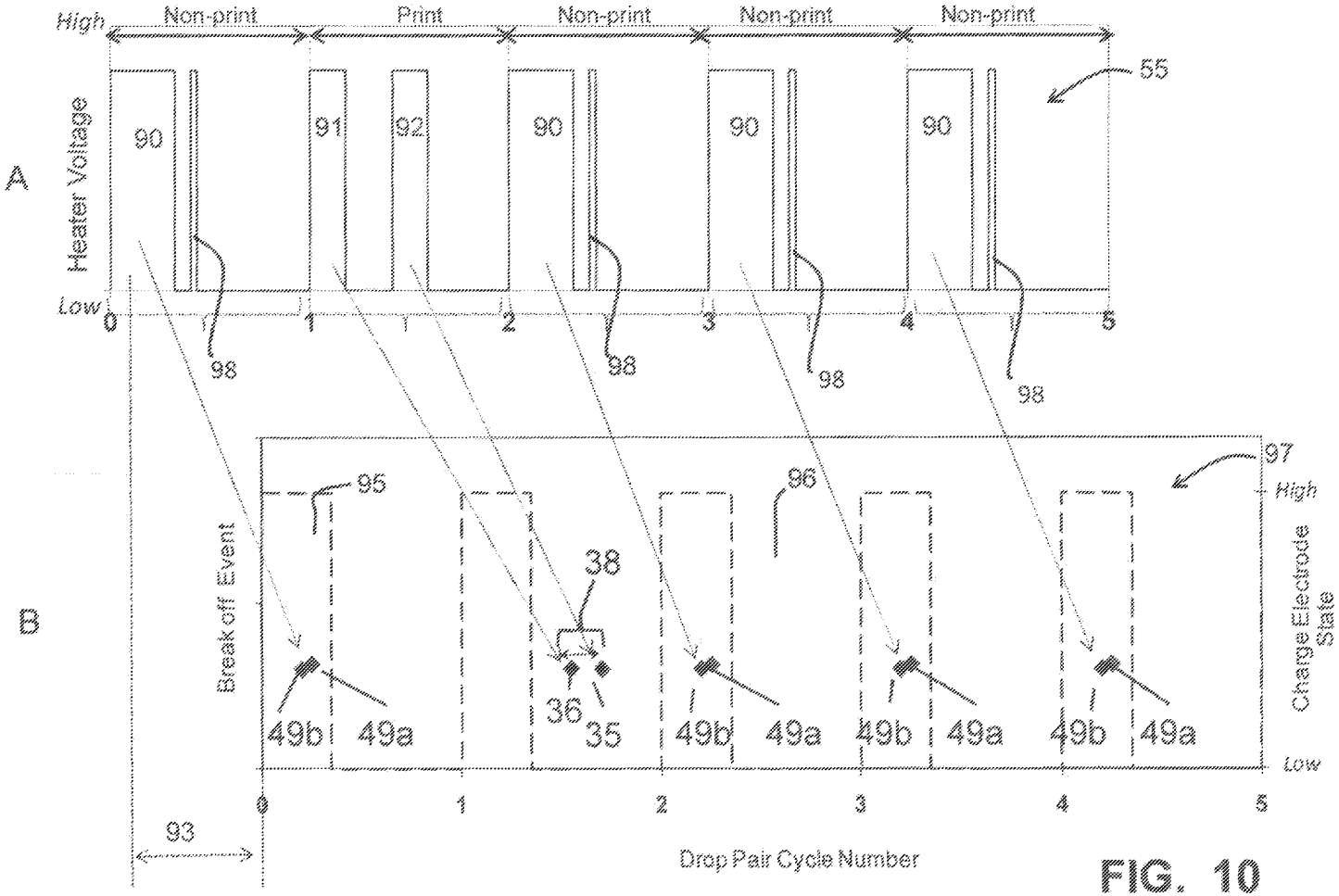
FIG. 10 shows a third embodiment of a timing diagram illustrating drop formation pulses, drop phase shifting pulses (A) and the charge electrode waveform, and the break off of drops (B)

FIGS. 8-10 show timing diagrams of various embodiment illustrating drop formation waveforms 55, velocity modulating pulses 94, charge electrode waveforms 97, and break off timing of drops as a function of time for 5 successive drop pair cycles. In these figures merged drops, which are printed, are formed from drops 35 and 36 that break off during the second drop pair cycle, while large drops 49 that break off during drop pair cycles 1, 3, 4 and 5 are not printed. In the examples shown in FIGS. 8-10 the drop formation transducer comprises a thermal actuator.

FIG. 8 shows an example timing diagram illustrating drop formation pulses applied to a thermal drop forming transducer in section (A), the charge electrode waveform applied to the charging electrode and the break off timing of drops in section (B) and the velocity modulating pulses applied to a separate thermal velocity modulation transducer in section (C). In this case the drop forming transducer and velocity modulating transducer are of the type shown in FIG. 4. Top section (A) of FIG. 8 shows a sequence of drop formation pulses for a sequence of drop pair time intervals. The time axis has been labeled in intervals of drop pair time periods, intervals or cycles, numbered from 1-5. The drop formation pulses for each successive drop pair period start at the beginning of the drop pair period, which corresponds to the end of the previous drop pair period. These drop formation pulses are applied to the drop formation device transducer by the drop formation source. The drop formation device transducer produces perturbations on the liquid jet flowing from the nozzle. As the frequency of these drop formation pulses is less than the cutoff frequency, discussed earlier, and is typically close to the optimum Rayleigh frequency, the perturbations grow until they each cause the end portion of the liquid jet to break off from the liquid jet. The number of pulses, the duration of the drop formation pulses, and in some embodiments the amplitude of the pulses, applied to the drop formation transducer during each print cycle (drop pair period) are dependent on the input image data. The input image binary data for print cycles 1-5 is shown at the bottom of FIG. 8 with double sided arrows indicated by Print or Non-print. During the non-print drop forming drop pair cycles 1, 3, 4 and 5, a single long heater voltage pulse 90 is applied to the drop formation transducer to cause the break off of a large drop 49. During the print drop forming drop pair cycle 2 a pair of shorter heater voltage pulses 91 and 92 are applied to the drop formation transducer to cause the break off of a first drop 36 and a second drop 35 which subsequently merge to form drop 38. It is to be noted that the drop velocity modulation waveform is supplied to the drop velocity modulation transducer only when the liquid jet is modulated to selectively cause portions of the liquid jet to break off into one or more pairs of drops. The moments in time at which the drops resulting from each of the heater voltage pulses break off from the liquid stream are shown as diamonds in section B of FIG. 8, and arrows are drawn from the respective voltage pulses to the respective break off event.

The middle section B of FIG. 8 also shows the charge electrode waveform 97 superimposed on the times at which the drop break off events occur. The charge electrode waveform 97 shown is a 2 state waveform having a first voltage state 95 and a second voltage state 96. In this embodiment, the first voltage state corresponds to a high positive voltage and the second voltage state corresponds to low or a negative voltage state. The heater voltage waveform 55 is synchronized with the charge electrode waveform 59 so that large drops 49 and first drops 36 break off from the liquid jets during the first voltage state and second drops 35 break off from the liquid jets during the second voltage state. In order to achieve this synchronization, the phase of the charge voltage waveform 97 is phase delayed relative to the phase of the drop formation waveform 59 by delay 93 indicated by a double arrow in section B of FIG. 8.

The lower section C of FIG. 8 shows the timing of a velocity modulation pulse 94 supplied by the velocity modulation source 54 to a velocity modulation device transducer 41 associated with the nozzle 50. The velocity modulation pulse is shown to be only applied during the second drop pair cycle in this case. The drop velocity modulation pulse will increase the velocity of the second drop 35 of drop pair 34 relative to first drop 36 of the drop pair so that they will merge into a large drop 38 before being deflected. The drop pairs that the velocity modulation pulses act on are shown as arrows going from the drop velocity modulation pulses 94 to the drops 35 and 36 of the drop pairs.

FIG. 9 shows a second example timing diagram illustrating drop formation and velocity modulating pulses applied to a thermal actuator based printhead in section (A) with the timing of the charge electrode waveform and the break off timing of drops in section (B). In this case, drop formation transducer and the velocity modulation transducer comprise the same transducer as shown in FIG. 5. The velocity modulating pulses 94 and the drop formation pulses 90, 91, and 92 are applied to the same drop formation transducer thermal actuator from the same waveform source. In this case, during the non-print drop pair cycles 1,3,4 and 5, the non-print drop forming pulse 90 is shown to break off as two closely spaced drops 49*a* and 49*b* which soon merge together as they travel down the initial path as shown in FIG. 3A. During the print drop pair cycle 2 the pair of heater voltage pulses 91 and 92 are applied to the drop formation transducer to cause the break off of a first drop 36 and a second drop 35 and the very short velocity modulation pulse 94 is applied after the first drop forming voltage pulse 91 and before the second drop forming voltage pulse 92 to cause first drop 36 and second drop 35 to subsequently merge to form drop 38.

In the illustrated drop charging waveforms of FIGS. 8 and 9, if the second voltage state 96 has a voltage of approximately the same amplitude, but opposite sign to the first voltage state 95, the second drop 35 will have a charge that is approximately the same amplitude, but of opposite sign to the first drop 36. When these two drops merge to form a large drop 39, the large drop will then have approximately zero charge. In embodiments that print with "uncharged" drops, the printing system can include a drop charge sensor to determine the charge of the merged drops. Based on the measured charge, the control can make voltage adjustments to one or both of the first and the second voltage states to drive the charge of the merged drop closer to zero. This can be beneficial as lower charge amplitudes on the print drops reduce the electrostatic drop-drop interactions that can affect drop placement accuracy on the print media.

Section B of FIG. 10 shows a timing diagram of an alternate embodiment of this invention showing the charge electrode waveform as function of drop pair cycle number along with the break off timing of drops. The drop formation waveforms that generate the break off timing are shown in section A of FIG. 10. Here the non-print drop formation waveform consists of the third drop formation pulse 90 followed by a short duration drop phase shifting pulse 98. The purpose of the drop phase shifting pulse 98 is to shift the timing or phase of the break off of the drops 49 formed by drop forming pulse 90 relative to the phase of the drop break off of the drop 36 formed by drop formation pulse 91. This increases the phase shift in the break off times between the drops 49 and drops 36 and 35, which provides increased latitude in adjusting the phase shift 93 of the drop charging waveform 97 relative to the drop stimulation waveform 55 so that drops 49 break off during the first charge voltage state 95 and the drops 36 and 35 break off during the second charge voltage state 96. In FIG. 10, both drops 36 and 35 that break off during the print drop forming drop pair cycle second drop pair cycle number break off when the second voltage state 96 is active, while drops 49 (49*a*,49*b*) break off when the first voltage state is active. Drops 36 and 35 merge to form drop 38 which will have a different charge state than drops 49. The charging electrode waveform 97 is shown here to have a 35% duty cycle with about 35% of the waveform cycle in the first voltage state 95 and about the remaining 65% of the time cycle in the second voltage state 96. It is advantageous to change the duty cycle to ensure that drops 36 and 35 both break off during the same voltage state of the charge electrode waveform 97.

In the illustrated drop charging waveforms of FIG. 10, drops 36 and 35 both break off during the low second voltage state 96 of the drop charging waveform 97. If the low voltage state 96 is approximately zero, these two drops will both have approximately zero charge, than they merge to form drop 38 also with approximately zero charge. In embodiments that print with "uncharged" drops, the printing system can include a drop charge sensor to determine the charge of the merged drops. Based on the measured charge, the control can make voltage adjustments to one or both of the first and the second voltage states to drive the charge of the merged drop closer to zero. This can be beneficial as lower charge amplitudes on the print drops reduce the electrostatic drop-drop interactions that can affect drop placement on the print media.

The embodiments shown in FIG. 6 and FIG. 7 can be used to selectively print drops having the timing diagrams shown in FIG. 8-FIG. 10. The induced charge states on print drops and non-print drops depends upon the relative voltage levels of the voltage states 95 and 96 of the charge electrode waveform's 97. When using the embodiments shown in FIG. 6, non-print drops can be charged negatively and print drops can be charged less negatively, be relatively neutral or be positively charged. Non-print drops can also be charged positively and print drops can be charged less positively, be relatively neutral or negatively charged. When using the embodiments shown in FIG. 7, print drops can be charged negatively and non-print drops can be charged less negatively, be relatively neutral or be positively charged. Print drops can also be charged positively and non-print drops can be charged less positively, be relatively neutral or be negatively charged.

Figure 11:
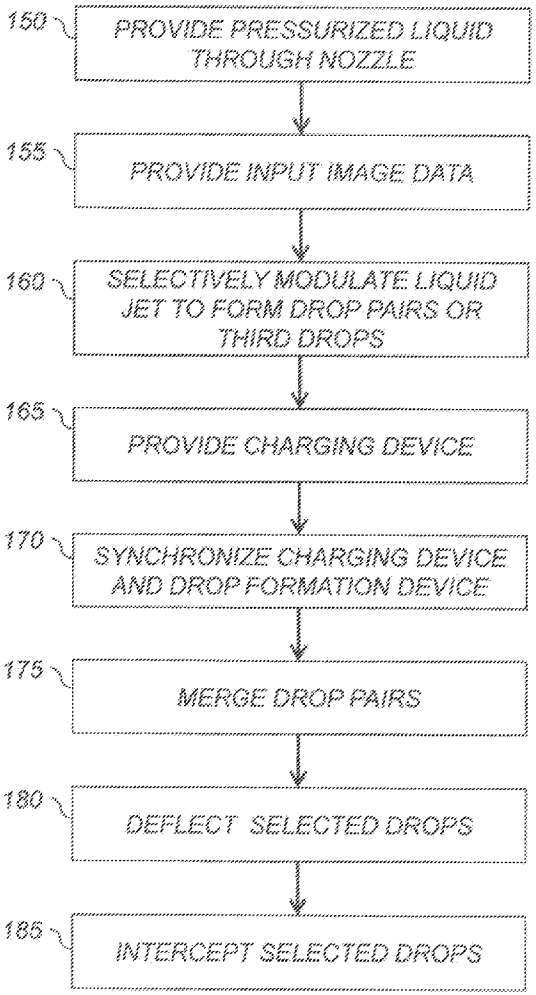
FIG. 11 shows a block diagram of a method of drop ejection according to an example embodiment of the invention.

FIG. 11 shows a block diagram outlining the steps required to practice the method of printing according to various embodiments of the invention. In step 150, pressurized liquid is provided under a pressure that is sufficient to eject a liquid jet through a nozzle or a linear array of nozzles. In step 155, input image data is provided. Input image data is usually in the form of binary data. In step 160, the liquid jets are selectively modulated to cause portions of the liquid jets to break off into one or more pairs of drops traveling along a path or to break off into one or more larger third drops traveling along the path. Each pair of drops includes a first drop and a second drop, and each pair of drops is separated on average by a drop pair period as are third drops. This is done by providing the drop formation devices associated with each of the liquid jets with drop formation waveforms that cause portions of the liquid jets to break off into a series of print drops or non-print drops in response to image data. Depending on the print configuration either drop pairs that are subsequently merged or larger third drops are print drops and the other of drop pairs that are subsequently merged or larger third drops are non-print drops. The input image data and the known recording medium speed during printing are used to determine which drop formation waveform is applied to each of the drop formation devices in an array of nozzles as a function of time.

In step 165, a charging device is provided. The charging device includes a charge electrode and a source of time varying electrical potential. The charge electrode is common to and associated with each of the liquid jets. The source of time varying electrical potential applies a charge electrode waveform between the charge electrode and the liquid jets. The charge electrode waveform includes a first distinct voltage state and a second distinct voltage state and has a period that is equal to the drop pair period. This results in a time varying electrical potential in the vicinity of drop break off from the liquid jets. The charge electrode waveform is independent of the image data applied to the drop formation devices of the nozzles.

In step 170, the charging device and the drop formation device are synchronized so that the print drop voltage state is active when print drops break off from the jets and the non-print drop voltage state is active when non-print drops break off from the liquid. This produces a first charge state on the first drop of the drop pairs, a second charge state on the second drop of the drop pairs, and a third charge state on the third drops.

In step 175 the first and second drops of drop pairs are merged. Drop merging mechanisms used in this invention include varying the velocity of the first and second drops of a drop pair with a separate drop velocity modulation transducer, using drop velocity modulation pulses applied to the drop formation transducer, by electrostatic attraction of oppositely charged drops of the drop pair or by combinations of any two or more approaches. Drop merging can be accomplished by applying velocity modulation pulses to the drop formation transducers or to separate velocity modulation transducers associated with each of the nozzles in a nozzle array and/or by electrostatic attraction. Application of the drop merging mechanism causes the first drop and the second drop of the drop pairs to combine with each other to form a fourth drop which has a fourth charge state.

In step 180, selected drops are deflected. Selected drops can be either third drops or fourth drops depending on the exact configuration of the printer. A deflection mechanism includes an electrostatic deflection device which causes the third drop to begin traveling along a first trajectory and causes the fourth drop to begin traveling along a second trajectory, the first and second trajectories being different when compared to each other. In step 185, drops traveling along one and only one of the first trajectory and the second trajectory are intercepted by a catcher for recycling. These drops are non print drops. The print drops that are traveling along the other trajectory are not intercepted by the catcher, and are allowed to contact the recording medium and are printed.

Generally this invention can be practiced to create print drops in the range of 1-100 pl, with nozzle diameters in the range of 5-50 μm, depending on the resolution requirements for the printed image. The jet velocity is preferably in the range of 10-30 m/s. The fundamental drop generation frequency is preferably in the range of 50-1000 kHz. The specific selection of these drop size, drop speed, nozzle size and drop generation frequency parameters is dependent on the printing application.

The invention allows drops to be selected for printing or non-printing without the need for a separate charge electrode to be used for each liquid jet in an array of liquid jets as found in conventional electrostatic deflection based ink jet printers. Instead a single common charge electrode is utilized to charge drops from the liquid jets in an array. This eliminates the need to critically align each of the charge electrodes with the nozzles. Crosstalk charging of drops from one liquid jet by means of a charging electrode associated with a different liquid jet is not an issue. Since crosstalk charging is not an issue, it is not necessary to minimize the distance between the charge electrodes and the liquid jets as is required for traditional drop charging systems. The common charge electrode also offers improved charging and deflection efficiency thereby allowing a larger separation distance between the jets and the electrode. Distances between the charge electrode and the jet axis in the range of 25-300 μm are useable. The elimination of the individual charge electrode for each liquid jet also allows for higher densities of nozzles than traditional electrostatic deflection continuous inkjet system, which require separate charge electrodes for each nozzle. The nozzle array density can be in the range of 75 nozzles per inch (npi) to 1200 npi.

The invention has been described in detail with particular reference to certain example embodiments thereof, but it will be understood that variations and modifications can be effected within the scope of the invention.

PARTS LIST

10 Continuous Inkjet Printing System
11 Ink Reservoir
12 Printhead or Liquid Ejector
13 Image Source
14 Deflection Mechanism
15 Ink Recycling Unit
16 Image Processor
17 Logic Controller
18 Stimulation controller
19 Recording Medium
20 Ink Pressure Regulator
21 Media Transport Controller
22 Transport Rollers
24 Liquid Chamber
27 Charged Drop Catcher Contact Location
30 Gutter Ledge
31 Drop Pair Merge Location
32 Break off Location
34 Drop Pair
35 Second Drop
36 First Drop
37 Print Drop Trajectory
38 Merged Drop or Fourth Drop
39 Non-Print Drop Trajectory
40 Continuous Liquid Ejection System
41 Drop Velocity Modulation Device Transducer
43 Liquid Jet
44 Charge electrode
**44*a*** Second Charge Electrode
**44*o*** Optional Symmetric Charge Electrode
46 Printed Drop
47 Catcher
48 Ink Film
49 Third Drop

49*a* Drop
49*b* Drop
50 Nozzle
51 Charging Voltage Source
52 Catcher Face
53 Deflection Electrode
54 Velocity Modulation Source
55 Drop Stimulation Waveform
56 Drop Formation Waveform Source
57 Catcher Bottom Plate
58 Ink Recovery Channel
59 Drop Stimulation Transducer
61 Air Plenum
63 Deflection Electrode
65 Arrow
67 Catcher
83 Charging Device
87 Liquid Jet Central Axis
90 Third Drop Forming Pulse
91 First Drop Forming Pulse
92 Second Drop Forming Pulse
93 Phase Delay
94 Drop Velocity Modulating Pulse
95 First Voltage State
96 Second Voltage State
97 Charge Electrode Waveform
98 Drop Phase Shifting Pulse
150 Provide Pressurized Liquid Step
155 Provide Input Image Data Step
160 Modulate Liquid Jet Step
165 Provide Charging Device Step
170 Synchronization Step
175 Merge Drop Pairs Step
180 Deflect Selected Drops Step
185 Intercept Selected Drops Step

The invention claimed is:

1. A method of ejecting liquid drops comprising:

providing liquid under pressure sufficient to eject a liquid jet through a nozzle of a liquid chamber;

providing input image data;

providing a drop formation device;

modulating the liquid jet to selectively cause portions of the liquid jet to break off into one or more pairs of drops traveling along a path using the drop formation device associated with the liquid jet, each pair of drops separated on average by a drop pair period, each pair of drops including a first drop and a second drop in response to the input image data;

modulating the liquid jet to selectively cause portions of the liquid jet to break off into one or more third drops traveling along the path separated on average by the same drop pair period using the drop formation device, the third drop being larger than the first drop and the second drop in response to the input image data;

providing a charging device including:

a charge electrode associated with the liquid jet; and a source of varying electrical potential between the charge electrode and the liquid jet, the source of varying electrical potential providing a waveform, the waveform having a period that is equal to the drop pair period, the waveform including a first distinct voltage state and a second distinct voltage state, the charging waveform being independent of the input image data;

synchronizing the charging device with the drop formation device to produce a first charge state on the first drop of the drop pairs, to produce a second charge state on the second drop of the drop pairs, and to produce a third charge state on the third drops;

providing a drop merging mechanism;

causing the first drop and the second drop of the drop pairs to combine with each other to form a fourth drop having a fourth charge state using the drop merging mechanism; and providing a deflection device;

causing the third drop to begin traveling along a first trajectory and causing the fourth drop to begin traveling along a second trajectory using the deflection mechanism, the first and second trajectories being different when compared to each other.

2. The method of claim 1, the drop merging mechanism including a drop velocity modulation device, wherein causing the first drop and the second drop of the drop pairs to combine with each other includes varying a relative velocity of the first drop and the second drop of the drop pair using the drop velocity modulation device.

3. The method of claim 2, wherein the drop formation device and the drop velocity modulation device are the same device.

4. The method of claim 2, wherein the drop velocity modulation device further comprises:

a drop velocity modulation transducer associated with one of the liquid chamber, the nozzle, and the liquid jet; and a drop velocity modulation waveform source that supplies a drop velocity modulation waveform to the drop velocity modulation transducer in response to the input image data.

5. The method of claim 4, wherein the drop velocity modulation transducer is one of a thermal device, a piezoelectric device, a MEMS actuator, and an electrohydrodynamic device, an optical device, an electrostrictive device, and combinations thereof.

6. The method of claim 4, wherein the drop velocity modulation waveform is supplied to the drop velocity modulation transducer during the time that the liquid jet is modulated to selectively cause portions of the liquid jet to break off into one or more pairs of drops.

7. The method of claim 1, wherein causing the first drop and the second drop of the drop pairs to combine with each other includes using a electrostatic attraction between the first drop having the first charge state and the second drop having the second charge state.

8. The method of claim 1, wherein the first drop and the second drop of the drop pair combine prior to being acted upon by the deflection device.

9. The method of claim 1, wherein forming the third drop includes merging two separate drops.

10. The method of claim 1, wherein the first trajectory is distinct from the path.

11. The method of claim 1, wherein the second trajectory is substantially coincident with the path.

12. The method of claim 1, further comprising:

providing a catcher; and intercepting drops traveling along one of the first trajectory and the second trajectory using the catcher.

13. The method of claim 12, wherein the deflection device includes the catcher.

14. The method of claim 1, wherein the deflection device further comprises a deflection electrode in electrical communication with a source of electrical potential that creates a drop deflection field to deflect charged drops.

15. The method of claim 1, the nozzle being one of a plurality of nozzles, wherein the charge electrode of the charging device is an electrode that is common to and associated with the liquid jets being ejected from the plurality of nozzles.

16. The method of claim 1, wherein the drop formation device further comprises:

a drop formation transducer associated with one of the liquid chamber, the nozzle, and the liquid jet; and a drop formation waveform source that supplies a plurality of drop formation waveforms to the drop formation transducer, each waveform being selected in response to the input image data.

17. The method of claim 16, wherein the drop formation transducer is one of a thermal device, a piezoelectric device, a MEMS actuator, and an electrohydrodynamic device, an optical device, an electrostrictive device, and combinations thereof.

18. The method of claim 16, wherein the plurality of drop formation waveforms includes a first drop formation waveform that creates the first and second drops of the drop pair and a second drop formation waveform that creates the third drops.

19. The method of claim 1, wherein the source of varying electrical potential between the charge electrode and the liquid jet produces a waveform in which the first distinct voltage state and the second distinct voltage state are each active for a time interval equal to one half of the drop pair period.

20. The method of claim 1, wherein the charging device comprises a charge electrode including a first portion positioned on a first side of the liquid jet and a second portion positioned on a second side of the liquid jet.

21. The method of claim 1, wherein the liquid includes ink for printing on a recording medium.

22. The method of claim 1, wherein the first drop of the drop pair and the second drop of the drop pair are formed during the first distinct voltage state of the charging device and the third drop is formed during the second distinct voltage state of the charging device.

23. The method of claim 1, wherein the first drop of the drop pair is formed during the first distinct voltage state of the charging device and the second drop of the drop pair is formed during the second distinct voltage state of the charging device.

24. The method of claim 1, wherein the second distinct voltage state includes a DC offset.

25. A continuous liquid ejection system comprising:

a liquid chamber in fluidic communication with a nozzle, the liquid chamber containing liquid under pressure sufficient to eject a liquid jet through the nozzle;

a drop formation device associated with the liquid jet, the drop forming device being configured to produce a modulation in the liquid jet to selectively cause portions of the liquid jet to break off into one or more pairs of drops traveling along a path, each drop pair separated on average by a drop pair period, each drop pair including a first drop and a second drop in response to input image data, the drop formation device also being configured to produce a modulation in the liquid jet to selectively cause portions of the liquid jet to break off into one or more third drops traveling along the path separated on average by the same drop pair period, the third drop being larger than the first drop and the second drop in response to input image data;

a charging device including:

a charge electrode associated with the liquid jet; and a source of varying electrical potential between the charge electrode and the liquid jet, the source of varying electrical potential providing a waveform, the waveform including a period that is equal to the drop pair period of formation of the drop pairs or the third drops, the waveform including a first distinct voltage state and a second distinct voltage state, the charging waveform being independent of input image data, the charging device being synchronized with the drop formation device to produce a first charge state on the first drop of the drop pair, a second charge state on the second drop of the drop pair, and a third charge state on the third drop; and a drop merging mechanism configured to cause the first drop and the second drop of the drop pair to combine with each other to form a fourth drop having a fourth charge state; and a deflection device configured to cause the third drop to begin traveling along a first trajectory and cause the fourth drop to begin traveling along a second trajectory, the first and second trajectories being different when compared to each other.

* * * * *